US009931546B2

(12) United States Patent
Mizutani

(10) Patent No.: US 9,931,546 B2
(45) Date of Patent: Apr. 3, 2018

(54) GOLF CLUB WITH TOOL FOR ENGAGING A WEIGHT BODY AND SCREW

(71) Applicant: DUNLOP SPORTS CO. LTD., Kobe-shi, Hyogo (JP)

(72) Inventor: Naruhiro Mizutani, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 14/721,650

(22) Filed: May 26, 2015

(65) Prior Publication Data

US 2015/0343279 A1 Dec. 3, 2015

(30) Foreign Application Priority Data

May 27, 2014 (JP) ..... 2014-109136

(51) Int. Cl.

| | |
|---|---|
| ***A63B 53/02*** | (2015.01) |
| ***A63B 53/04*** | (2015.01) |
| ***A63B 53/06*** | (2015.01) |
| ***A63B 57/00*** | (2015.01) |
| *A63B 53/14* | (2015.01) |

(52) U.S. Cl.

CPC ..... *A63B 53/02* (2013.01); *A63B 57/00* (2013.01); *A63B 53/14* (2013.01); *A63B 2053/0491* (2013.01)

(58) Field of Classification Search

CPC ..... A63B 53/06; A63B 53/02
USPC ..... 473/324–350, 287–292, 256, 354, 432
See application file for complete search history.

(56) References Cited

U.S. PATENT DOCUMENTS

| | | | | |
|---|---|---|---|---|
| 3,556,533 | A * | 1/1971 | Hollis | A63B 53/04 411/900 |
| 3,606,327 | A * | 9/1971 | Gorman | A63B 53/04 473/297 |
| 3,652,094 | A * | 3/1972 | Glover | A63B 53/08 473/337 |
| 4,795,159 | A * | 1/1989 | Nagamoto | A63B 53/04 473/338 |
| 5,251,901 | A * | 10/1993 | Solheim | A63B 53/04 473/338 |

(Continued)

FOREIGN PATENT DOCUMENTS

| | | |
|---|---|---|
| JP | 2014-18350 A | 2/2014 |
| JP | 2014-57832 A | 4/2014 |

OTHER PUBLICATIONS

Carr Lan Manufacturing Co., Spring-Loaded Devices, Technical Information Ball Plungers, https://www.carrlane.com/catalog/index.cfm/29425071F0B221118070C1C5139061-03E0B05543B0B012009083C3B285356444A2D020609090-C0015312A36515F57425B, Mar. 2006.*

(Continued)

*Primary Examiner* — William Pierce
(74) *Attorney, Agent, or Firm* — Birch, Stewart, Kolasch & Birch, LLP

(57) ABSTRACT

A golf club 2 includes a head 4, a shaft 6, a grip 8, a first member m1 detachably attached, a second member m2 detachably attached, and a tool 102. A minimum force required to detach the first member m1 from the tool 102 in a connection state of the tool 102 and the first member m1 is defined as F1. A minimum force required to detach the second member m2 from the tool 102 in a connection state of the tool 102 and the second member m2 is defined as F2. The force F1 is greater than the force F2.

10 Claims, 23 Drawing Sheets

(56) References Cited

U.S. PATENT DOCUMENTS 5,582,553 A * 12/1996 Ashcraft ..... A63B 53/04 473/338
6,033,318 A * 3/2000 Drajan, Jr. ..... A63B 53/02 473/309
6,193,614 B1 * 2/2001 Sasamoto ..... A63B 53/04 473/329
6,290,609 B1 * 9/2001 Takeda ..... A63B 53/047 473/335
7,500,924 B2 * 3/2009 Yokota ..... A63B 53/0466 473/332
7,582,024 B2 * 9/2009 Shear ..... A63B 53/0466 473/329
7,632,194 B2 * 12/2009 Beach ..... A63B 53/0466 473/334
7,744,484 B1 * 6/2010 Chao ..... A63B 53/0466 473/324
8,430,763 B2 * 4/2013 Beach ..... A63B 53/06 473/307
8,562,457 B2 * 10/2013 Beach ..... A63B 53/0466 473/335
8,821,312 B2 * 9/2014 Burnett ..... A63B 49/06 473/329
8,827,831 B2 * 9/2014 Burnett ..... A63B 49/06 473/329
8,888,607 B2 * 11/2014 Harbert ..... A63B 53/04 473/307
8,900,069 B2 * 12/2014 Beach ..... A63B 53/06 473/329
9,220,953 B2 * 12/2015 Beach ..... A63B 53/04
2002/0137576 A1 * 9/2002 Dammen ..... A63B 53/04 473/336
2004/0192463 A1 * 9/2004 Tsurumaki ..... A63B 53/0466 473/329
2006/0293115 A1 12/2006 Hocknell et al.
2011/0021284 A1 * 1/2011 Stites ..... A63B 53/0466 473/329
2012/0071261 A1 3/2012 Yamamoto
2012/0142447 A1 * 6/2012 Boyd ..... A63B 60/54 473/329
2014/0024475 A1 1/2014 Motokawa
2014/0080628 A1 3/2014 Sargent et al.
2014/0187347 A1 * 7/2014 Yamamoto ..... A63B 53/047 473/335
2014/0274446 A1 * 9/2014 Greaney ..... A63B 53/0466 473/307

OTHER PUBLICATIONS

Teco, Spring Loaded Devices, http://www.te-co.com/pdf/springloadeddevices.pdf, 2016.*

* cited by examiner

GOLF CLUB WITH TOOL FOR ENGAGING A WEIGHT BODY AND SCREW

The present application claims priority on Patent Application No. 2014-109136 filed in JAPAN on May 27, 2014, the entire contents of which are hereby incorporated by reference.

BACKGROUND OF THE INVENTION

Field of the Invention

The present invention relates to a golf club.

Description of the Related Art

U.S. Patent Application Publication No. 2006/0293115 and Japanese Patent Application Laid-Open No. 2012-86010 (U.S. Patent Application Publication No. 2012/0071261) disclose a golf club including a head and a shaft detachably attached to the head.

SUMMARY OF THE INVENTION

In the literatures, a sleeve is provided in a tip part of the shaft, and is fixed by a screw. The screw is a member detachably attached. According to a study by the inventor of the present application, it has been found that if a plurality of the members attached, workability of attachment and detachment is apt to be decreased.

It is an object of the present invention to provide a golf club including a member detachably attached, and having excellent handling property of the member.

A preferable golf club of the present invention includes: a head; a shaft; a grip; a first member detachably attached; a second member detachably attached; and a tool capable of being used to detach the first member and the second member. A minimum force required to detach the first member from the tool in a connection state of the tool and the first member is defined as F1. A minimum force required to detach the second member from the tool in a connection state of the tool and the second member is defined as F2. In the golf club, the force F1 is greater than the force F2.

Preferably, the first member is not disengaged under the first member's own weight from the tool in the connection state of the tool and the first member. Preferably, the second member is disengaged under the second member's own weight from the tool in the connection state of the tool and the second member.

Preferably, gravity acting on the first member is less than the force F1. Preferably, gravity acting on the second member is equal to or greater than the force F2.

Preferably, the tool further includes a holding mechanism. Preferably, the first member includes an engaging part capable of being engaged with the holding mechanism.

Preferably, the tool further includes a holding mechanism. Preferably, the second member includes an avoiding part capable of avoiding engagement with the holding mechanism.

Preferably, the holding mechanism includes a projection part biased in a projection direction. Preferably, if the projection part is pressed against the biasing, the projection part retracts.

Preferably, the golf club further includes a socket fixed to the head, and a sleeve fixed to a tip part of the shaft. Preferably, the first member is a weight body detachably attached to the socket. Preferably, the second member is a screw capable of fixing the sleeve to the head.

Preferably, the shaft including the sleeve can be separated from the head in a state where the screw is not separated from the head.

A preferable golf club according to another aspect of the present invention includes: a head; a shaft; a grip; a first member detachably attached; a second member detachably attached; and a tool capable of being used to detach the first member and the second member. The first member is not disengaged under the first member's own weight from the tool in a connection state of the tool and the first member. The second member is disengaged under the second member's own weight from the tool in a connection state of the tool and the second member.

DESCRIPTION OF THE PREFERRED EMBODIMENTS

Hereinafter, the present invention will be described in detail based on the preferred embodiments with appropriate references to the accompanying drawings.

Figure 1:
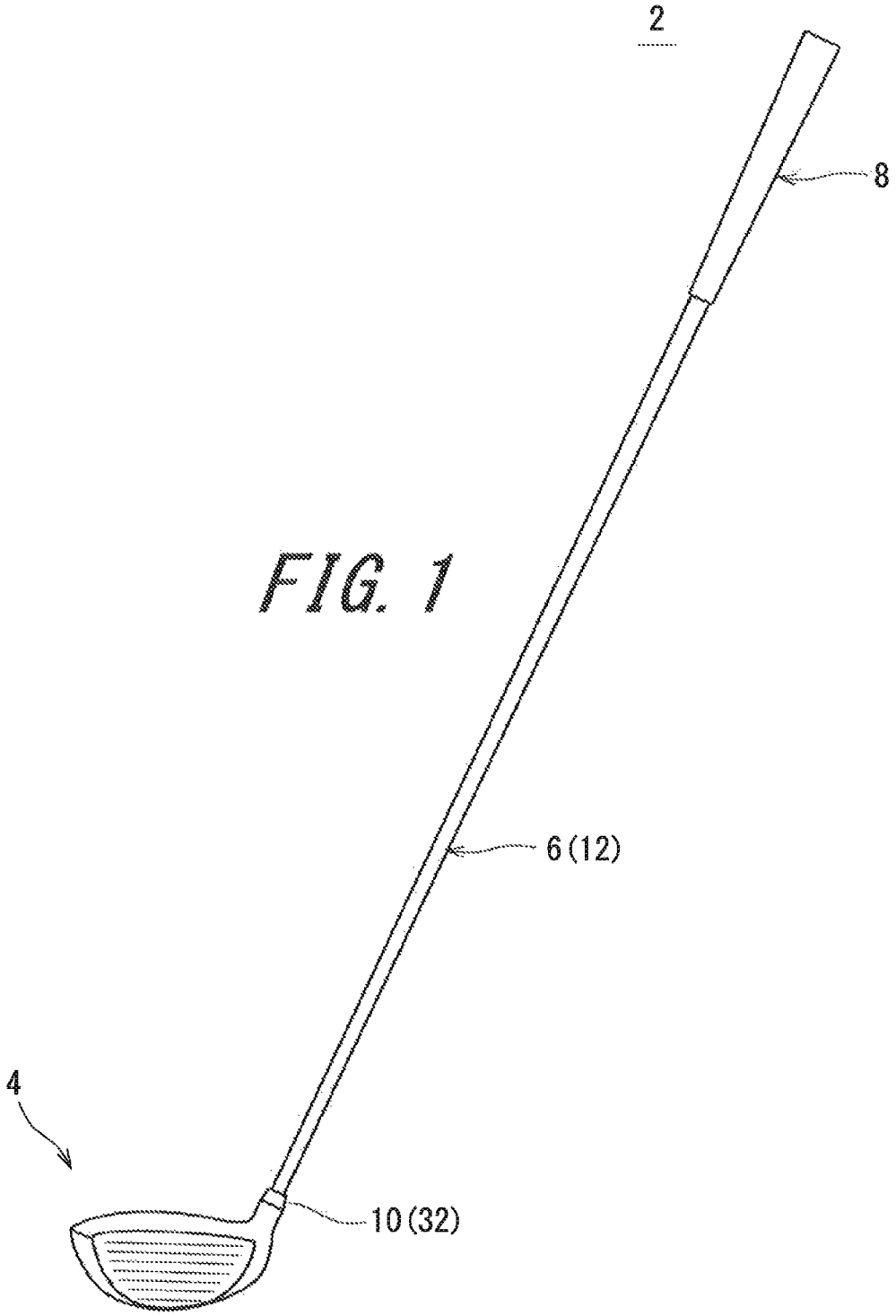
FIG. 1 shows a golf club according to one embodiment of the present invention.
Figure 2:
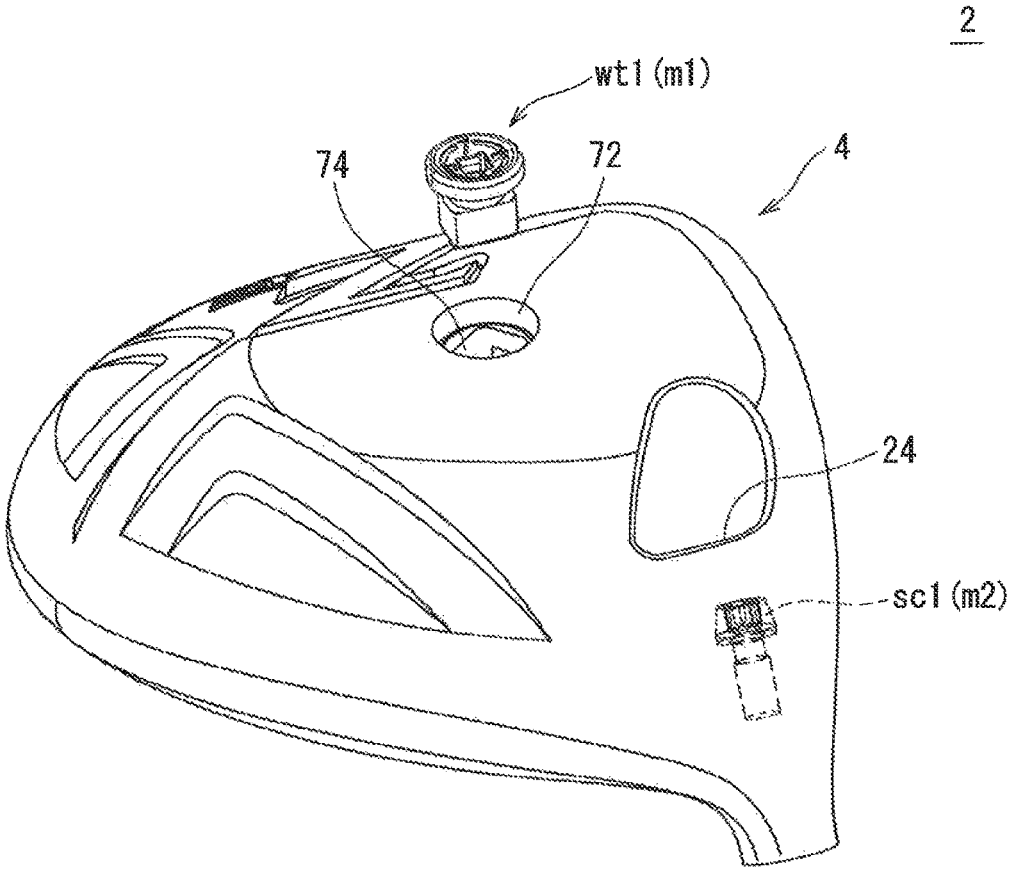
FIG. 2 is an exploded view of the golf club of FIG. 1, and shows only a vicinity of a head.
Figure 2:
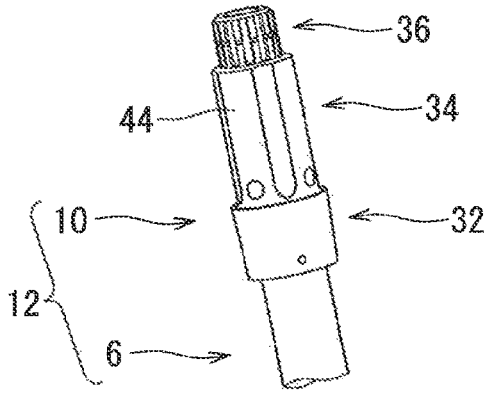

FIG. 1 shows a golf club 2 according to one embodiment of the present invention. FIG. 2 is an exploded perspective view of the golf club 2.

As shown in FIG. 1, the golf club 2 includes a head 4, a shaft 6, and a grip 8. The head 4 is attached to one end part of the shaft 6. The grip 8 is attached to the other end part of the shaft 6.

The type of the head 4 is not limited. The head 4 of the embodiment is a wood type golf club head. The head 4 may be a utility type head, a hybrid type head, an iron type head, and a putter head or the like. A carbon shaft and a steel shaft may be used as the shaft 6.

As shown in FIG. 2, the golf club 2 further includes a sleeve 10. The sleeve 10 is fixed to a tip of the shaft 6. The sleeve 10 is bonded to the tip of the shaft 6. A shaft-sleeve assembly 12 is formed by the shaft 6 and the sleeve 10 fixed to each other (see FIG. 2).

The golf club 2 further includes a screw sc1. The screw sc1 can be screw-connected to the sleeve 10. The screw sc1 can fix the sleeve 10 to the head 4. The screw sc1 can fix the shaft-sleeve assembly 12 to the head 4. The shaft 6 (shaft-sleeve assembly 12) is detachably attached to the head 4 by the screw sc1. The screw sc1 is detachably attached to the golf club 2. In FIG. 2, the screw sc1 located in the head 4 is shown by a dashed line.

As shown in FIG. 2, the golf club 2 further includes a weight body wt1. The weight body wt1 is detachably attached to the head 4.

The golf club 2 includes a first attaching/detaching mechanism and a second attaching/detaching mechanism. The first attaching/detaching mechanism is a shaft attaching/detaching mechanism. The first attaching/detaching mechanism enables a shaft connection state where the shaft 6 (shaft-sleeve assembly 12) is connected to the head 4, and a shaft separation state where the shaft 6 (shaft-sleeve assembly 12) is separated from the head 4. The golf club 2 is used in the shaft connection state. The second attaching/detaching mechanism is a weight body attaching/detaching mechanism. The second attaching/detaching mechanism enables the attachment and detachment of the weight body wt1. The weight body wt1 is detachably attached to the head 4.

The first attaching/detaching mechanism and the second attaching/detaching mechanism satisfy the Golf Rules defined by R&A (Royal and Ancient Golf club of Saint Andrews). That is, these mechanisms satisfy requirements specified in "1b Adjustability" in "1 Clubs" of "Appendix II Design of Clubs" defined by R&A. The requirements defined by the "1b Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform with the Rules.

[First Attaching/Detaching Mechanism]

Figure 3:
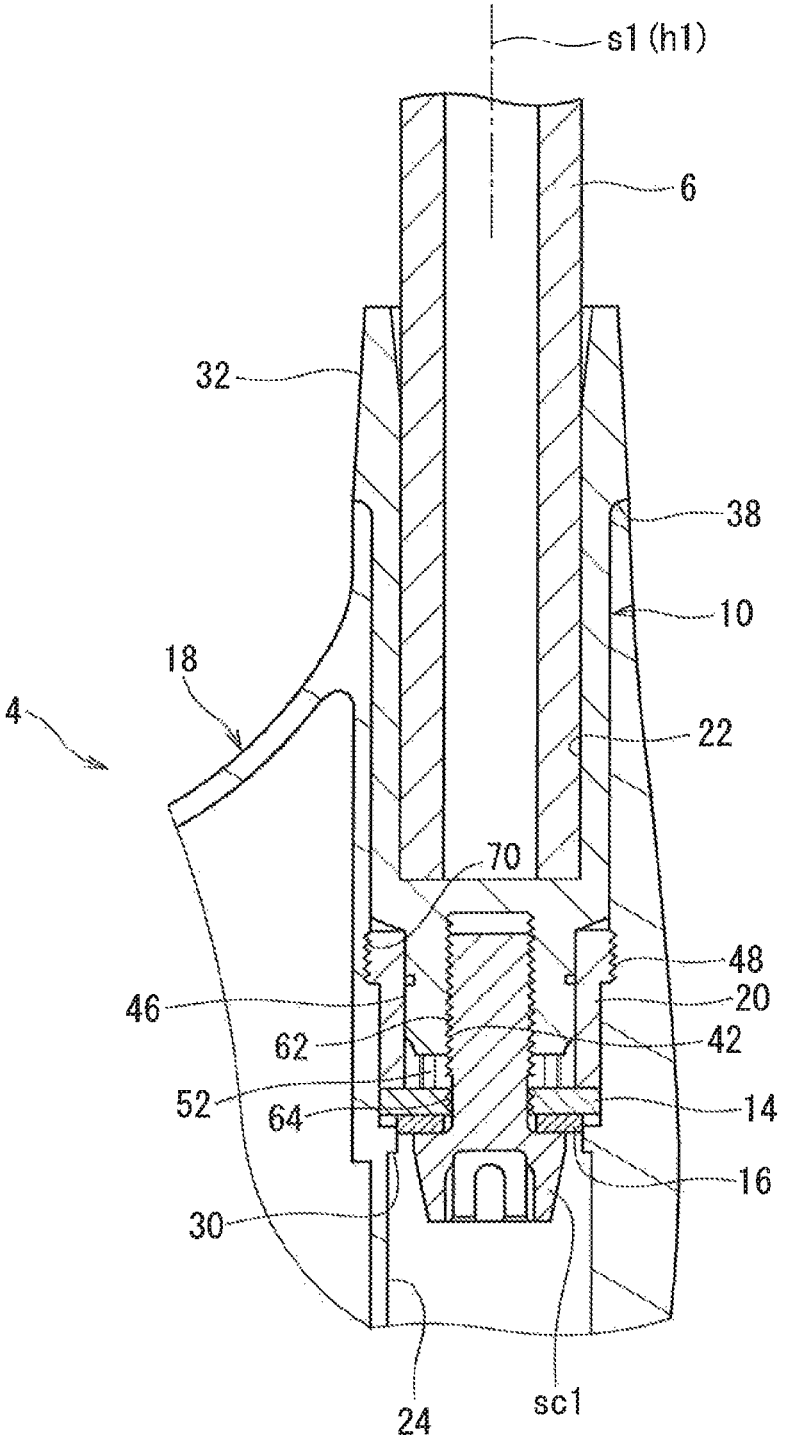
FIG. 3 is a cross-sectional view of the golf club of FIG. 1, shows only a vicinity of a hosel, and shows a shaft connection state.
Figure 4:
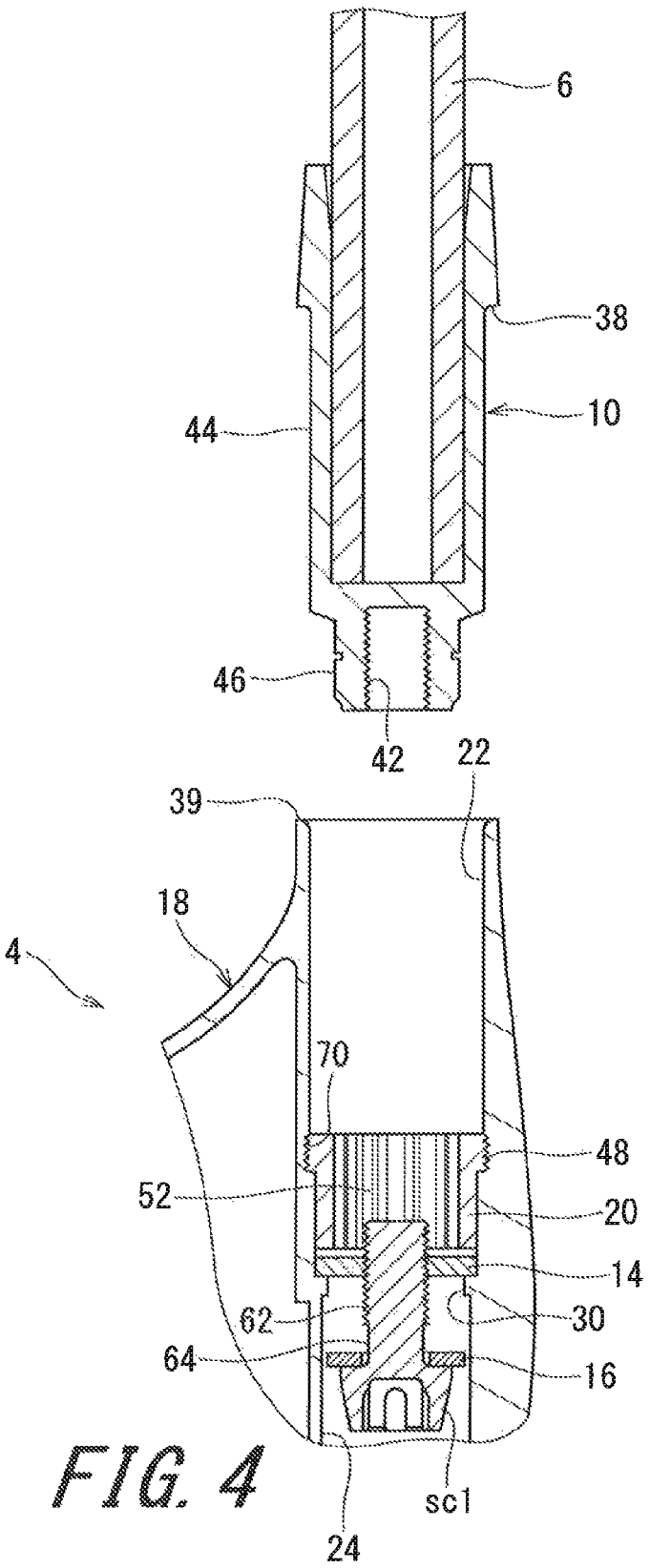
FIG. 4 is an exploded view of FIG. 3, and shows a shaft separation state.

FIG. 3 is a cross-sectional view of the golf club 2. FIG. 3 shows only a vicinity of a hosel. FIG. 3 is a cross-sectional view along a center axis line of the sleeve 10. FIG. 3 is a cross-sectional view in the shaft connection state. FIG. 4 is a cross-sectional view of the golf club 2. FIG. 4 is a cross-sectional view in the shaft separation state. FIGS. 3 and 4 are cross-sectional views along the center axis line of the sleeve 10.

The golf club 2 includes an intermediate member 14 and a washer 16 in addition to the sleeve 10 and the screw sc1. The head 4 includes a head body 18 and an engaging member 20. The head body 18 has a hosel hole 22 and a through hole 24. The through hole 24 penetrates a bottom part of the hosel hole 22, and reaches a sole. The head body 18 has a hollow part.

As shown in FIG. 3, the head body 18 includes a flange 30. The flange 30 is located on a sole side of the sleeve 10 in the shaft connection state. The inner diameter of the flange 30 is greater than the outer diameter of the washer 16.

The screw sc1 can be screw-connected to the sleeve 10. The shaft-sleeve assembly 12 is fixed to the head 4 by fastening the screw sc1. The shaft connection state is achieved by the fixation. The shaft-sleeve assembly 12 is separated from the head 4 by loosening the screw sc1, and thereby the shaft separation state is achieved.

Figure 5:
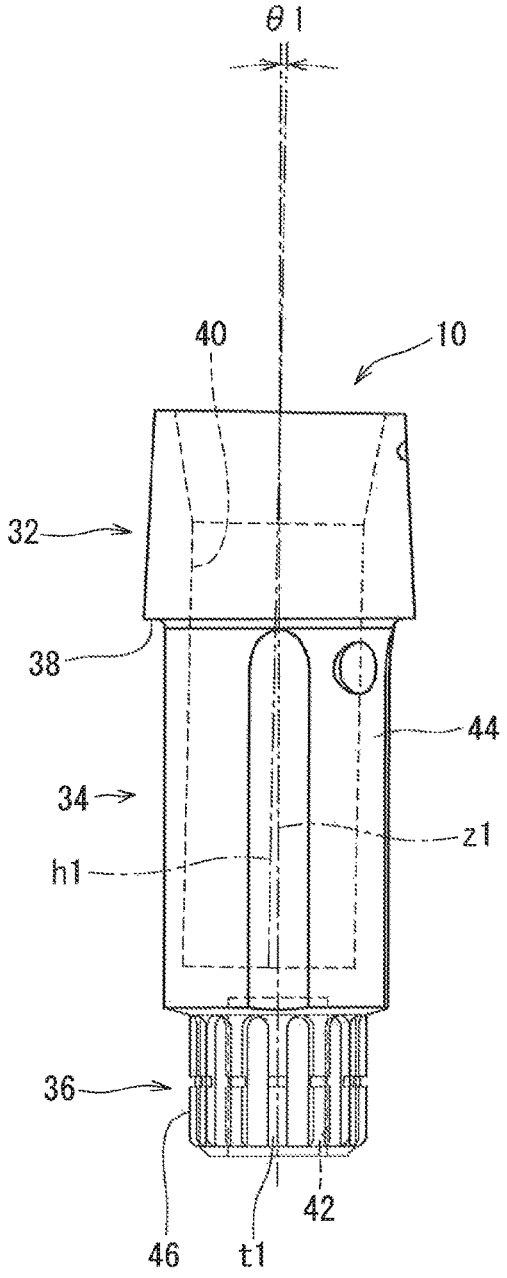
FIG. 5(*a*) is a side view of a sleeve, and FIG. 5(*b*) is a side view of the sleeve viewed from another point of view.
Figure 5:
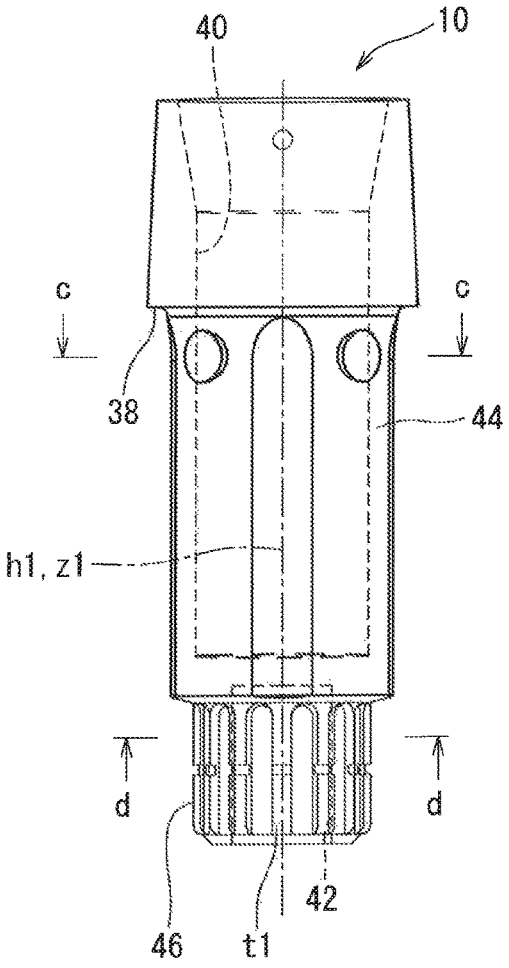
Figure 6:
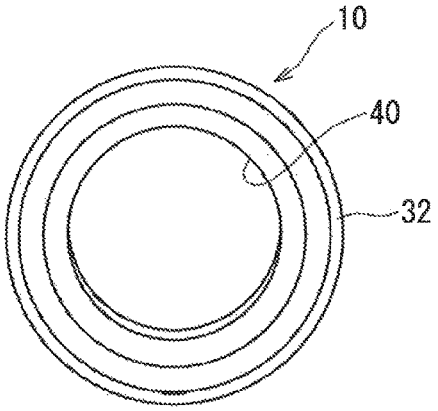
FIG. 6 (*a*) is a plan view of the sleeve, FIG. 6 (*b*) is a bottom view of the sleeve, FIG. 6(*c*) is a cross-sectional view taken along line c-c of FIG. 5 (*b*), and FIG. 6(*d*) is a cross-sectional view taken along line d-d of FIG. 5(*b*)
Figure 6:
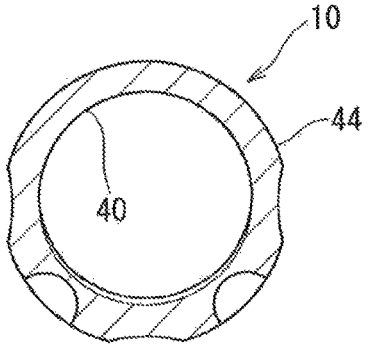
Figure 6:
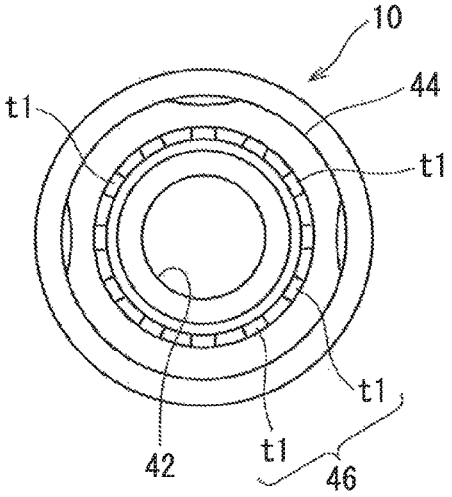
Figure 6:
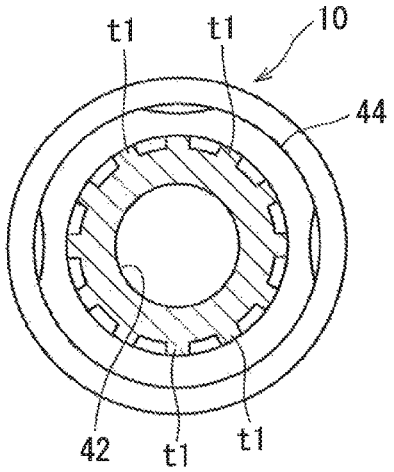

FIGS. 5(*a*) and 5(*b*) are side views of the sleeve 10. A point of view in FIG. 5(*a*) is different by 90 degrees from a point of view in FIG. 5(*b*). FIG. 6(*a*) is a plan view of the sleeve 10. FIG. 6 (*b*) is a bottom view of the sleeve 10. FIG. 6 (*c*) is a cross-sectional view taken along line c-c of FIG. 5 (*b*). FIG. 6 (*d*) is a cross-sectional view taken along line d-d of FIG. 5 (*b*).

The sleeve 10 includes an upper part 32, an intermediate part 34, and a lower part 36. A bump surface 38 is present at the boundary between the upper part 32 and the intermediate part 34. The sleeve 10 has a shaft hole 40 and a screw hole 42. The shaft hole 40 is located inside of the upper part 32 and the intermediate part 34. The shaft hole 40 is opened toward the upper side of the sleeve 10. The screw hole 42 is located inside of the lower part 36. The screw hole 42 is opened toward the lower side of the sleeve 10. As shown in FIG. 4, the screw hole 42 forms a female screw.

The upper part 32 is exposed in the shaft connection state (see FIGS. 1 and 3). In the shaft connection state, the bump surface 38 abuts on a hosel end face 39 of the head 4. An outer diameter of a lower end of the upper part 32 is substantially equal to an outer diameter of the hosel end face 39. In the shaft connection state, the upper part 32 exhibits an appearance like a ferrule. In the shaft connection state, the intermediate part 34 and the lower part 36 are located inside of the hosel hole 22.

An outer surface of the intermediate part 34 of the sleeve 10 includes a circumferential surface 44. In the shaft connection state, the circumferential surface 44 is brought into contact with the hosel hole 22. The contact is surface contact. The entire circumferential surface 44 is brought into contact with the hosel hole 22. In the shaft connection state, the hosel hole 22 supports the sleeve 10.

The sleeve 10 includes a rotation-preventing part 46. The rotation-preventing part 46 is provided on an outer surface of the lower part 36. As shown in FIG. 6(*d*), the rotation-preventing part 46 has a non-circular sectional shape. The rotation-preventing part 46 includes a plurality of projections t1. The projections t1 are outwardly projected. The projections t1 are disposed at equal intervals in a circumferential direction.

As shown in FIG. 5(*a*), an axis line h1 of the shaft hole 40 is inclined to an axis line z1 of the circumferential surface 44 of the sleeve 10. The inclination angle θ1 is a maximum value of an angle between the axis line h1 and the axis line z1. In the shaft connection state, the axis line z1 is equal to an axis line e1 of the hosel hole 22. The axis line h1 of the shaft hole 40 is equal to an axis line s1 of the shaft 6 (see FIG. 3). Based on the angle θ1, a loft angle, lie angle, and face angle of the golf club 2 can be adjusted.

Figure 7A:
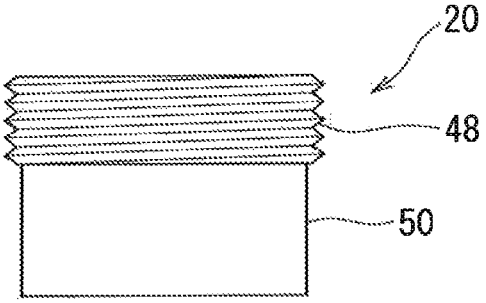
FIG. 7(*a*) is a side view of an engaging member, and FIG. 7(*b*) is a plan view of the engaging member.
Figure 7B:
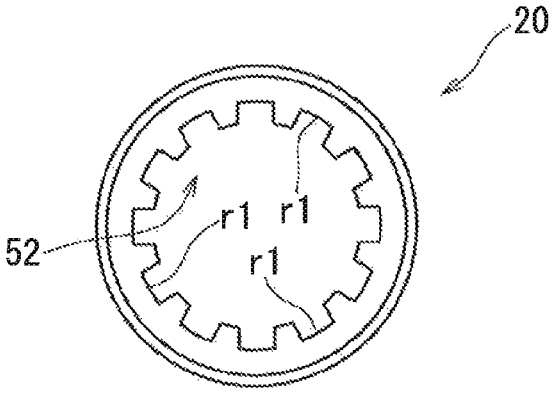

FIG. 7 (*a*) is a side view of the engaging member 20. FIG. 7 (*b*) is a bottom view of the engaging member 20. The engaging member 20 has a tubular shape as a whole. An outer surface of the engaging member 20 includes a screw part 48 and a non-screw part 50. The screw part 48 is a male screw. The non-screw part 50 is a circumferential surface.

As shown in FIG. 7 (*b*), an inner surface of the engaging member 20 has a non-circular sectional shape. The sectional shape of the inner surface of the engaging member 20 corresponds to the sectional shape of an outer surface of the rotation-preventing part 46 of the sleeve 10. A plurality of recesses r1 are formed in the inner surface of the engaging member 20. The shapes of the recesses r1 correspond to the shapes of the projections t1 described above. The recesses r1 are formed at equal intervals in the circumferential direction.

The inner surface of the engaging member 20 forms a rotation-preventing part 52. The rotation-preventing part 52 is engaged with the rotation-preventing part 46 of the sleeve 10. The engagement prevents the rotation of the sleeve 10.

Figure 8A:
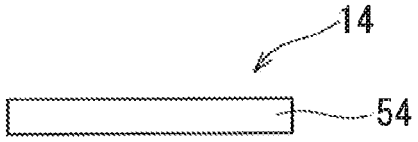
FIG. 8(*a*) is a side view of an intermediate member, FIG. 8(*b*) is a plan view of the intermediate member, and FIG. 8(*c*) is a cross-sectional view of the intermediate member.
Figure 8B:
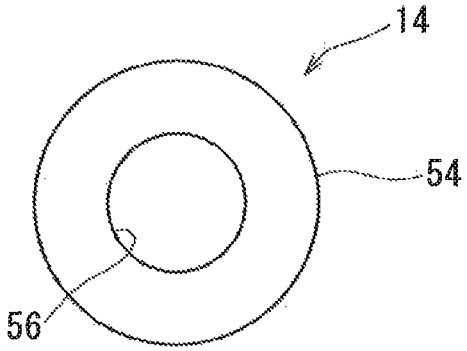
Figure 8C:
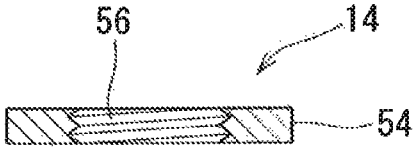

FIG. 8(*a*) is a side view of the intermediate member 14. FIG. 8(*b*) is a bottom view of the intermediate member 14. FIG. 8(*c*) is a cross-sectional view of the intermediate member 14. The intermediate member 14 is a circular member as a whole. An outer peripheral surface 54 of the intermediate member 14 is a circumferential surface. An inner peripheral surface 56 of the intermediate member 14 is a screw part. The inner peripheral surface 56 is a female screw.

Figure 9A:
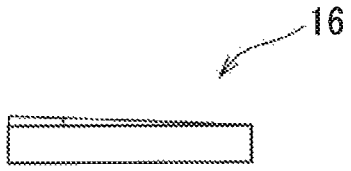
FIG. 9(*a*) is a side view of a washer, and FIG. 9(*b*) is a plan view of the washer.
Figure 9B:
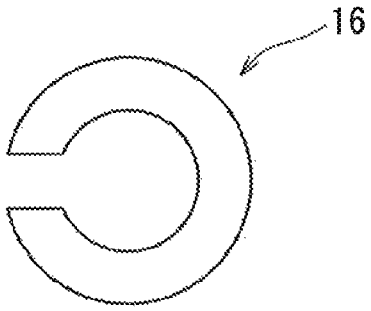

FIG. 9(*a*) is a side view of the washer 16. FIG. 9(*b*) is a bottom view of the washer 16. The washer 16 is an annular member disconnected at one place in a circumferential direction.

Figure 10:
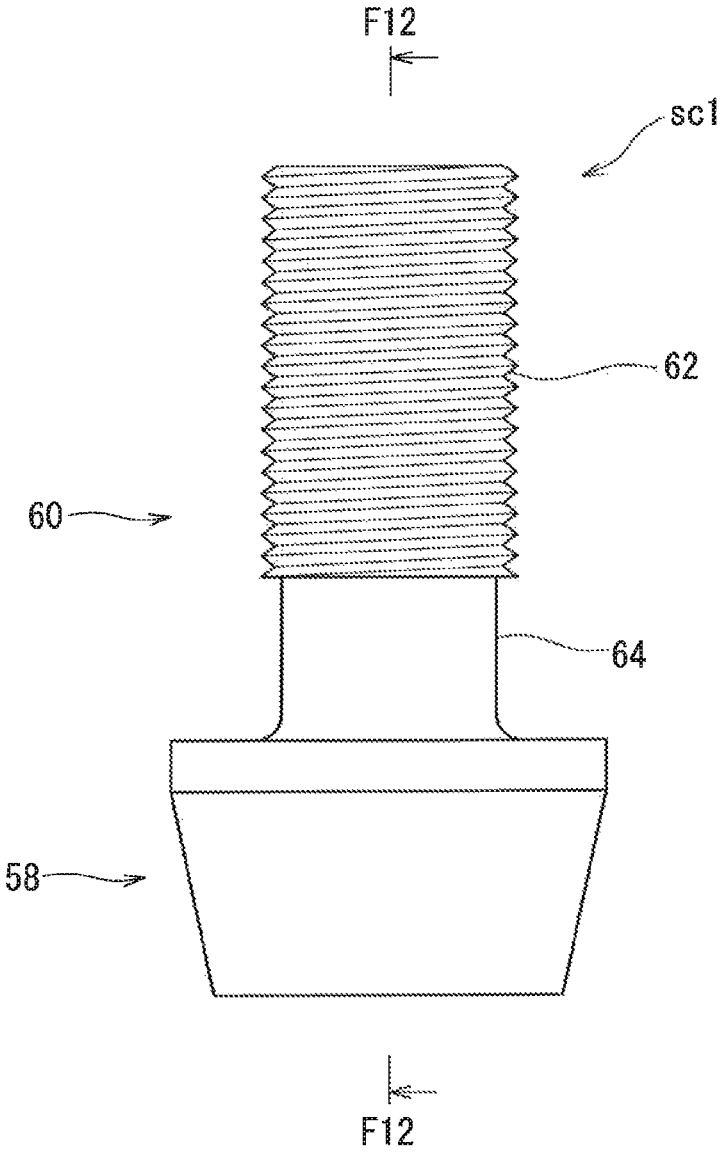
FIG. 10 is a side view of a screw (screw for fixing a shaft)
Figure 11:
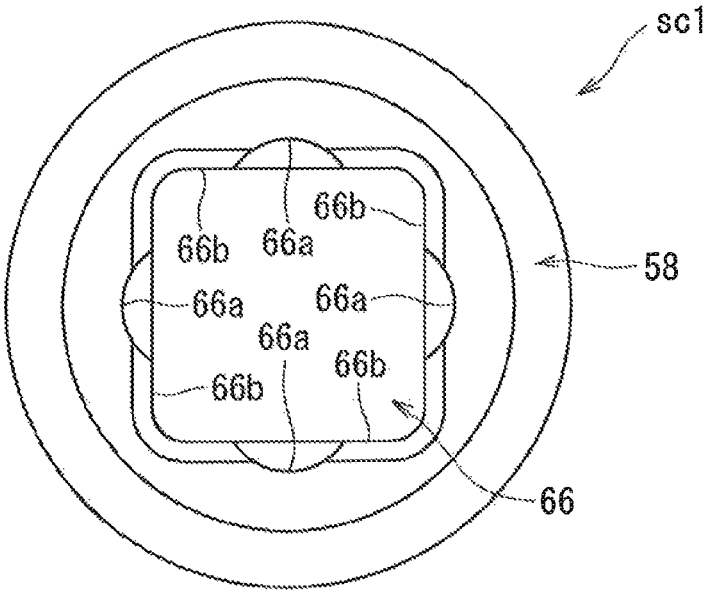
FIG. 11 is a plan view of the screw of FIG. 10.
Figure 12:
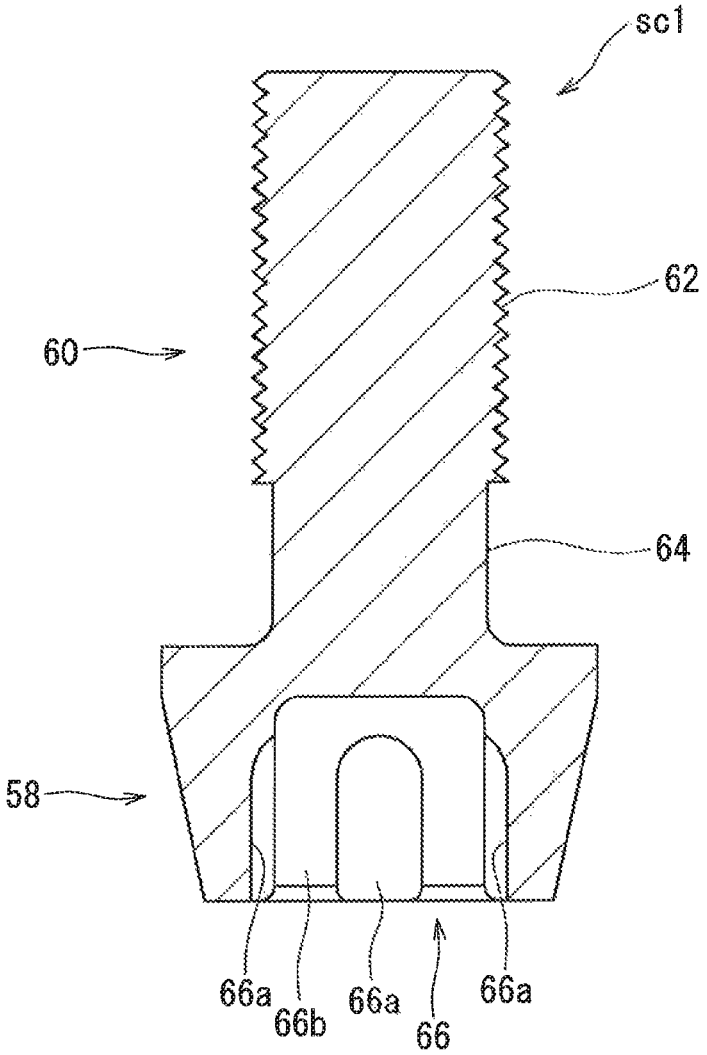
FIG. 12 is a cross-sectional view of the screw of FIG. 10.

FIG. 10 is a side view of the screw sc1. FIG. 11 is a plan view of the screw sc1. FIG. 12 is a cross-sectional view taken along line F12-F12 of FIG. 10.

The screw sc1 includes a head part 58 and an axis part 60. The axis part 60 includes a screw part 62 and a non-screw part 64. The non-screw part 64 is located on the head part 58 side with respect to the screw part 62. The screw part 62 forms a male screw. An outer surface of the non-screw part 64 is a circumferential surface.

The screw sc1 includes a tool inserting part 66. The tool inserting part 66 is formed in the head part 58. The tool inserting part 66 is a recess. A tool 102 described later is inserted into the tool inserting part 66. The screw sc1 can be axially rotated by the tool 102 adapted into the tool inserting part 66. The axial rotation enables the attachment and detachment of the sleeve 10. That is, the axial rotation enables the attachment and detachment of the assembly 12.

As shown in FIGS. 11 and 12, the screw sc1 includes an avoiding part 66*a*. The avoiding part 66*a* is a groove. The groove extends along a tool insertion direction. The tool insertion direction is a direction where the tool 102 (described later) is inserted. The groove reaches an end face of the head part 58. For this reason, the groove is opened at the end face of the head part 58 (see FIG. 11). A plurality of avoiding parts 66*a* are formed. In the embodiment, four avoiding parts 66*a* are formed (see FIG. 11). The tool inserting part 66 has a quadrangular sectional shape. For this reason, the tool inserting part 66 includes four planes 66*b*. The avoiding part 66*a* is formed in each of these planes 66*b*. When the tool inserting part 66 has an n-polygonal sectional shape and the tool inserting part 66 includes n planes 66*b*, the avoiding part 66*a* is preferably formed in each of these n planes 66*b*. n is a natural number equal to or greater than 3. n is preferably equal to or less than 12, and more preferably equal to or less than 8. n is particularly preferably 4, 6, or 8. The n-polygon is preferably a regular n-polygon.

The withdrawal of the sleeve 10 is prevented by screw connection. The screw connection is connection of the screw hole 42 with the screw part 62 (see FIG. 3). An axial force caused by the screw connection is balanced with a pressure between the hosel end face 39 and the bump surface 38.

As described above, the projections t1 of the rotation-preventing part 46 are engaged with the recesses r1 of the rotation-preventing part 52. The engagement prevents the rotation of the sleeve 10.

The engaging member 20 including the rotation-preventing part 52 is fixed to the head body 18 (see FIGS. 3 and 4).

A method for fixing the engaging member 20 is not limited. Examples of the fixing method include welding, bonding, fitting, screw connection, and a combination of them. In the embodiment, the screw connection is employed as the method for fixing the engaging member 20. As shown in FIGS. 3 and 4, a screw part 70 is formed in the hosel hole 22. The screw part 70 is a female screw. The screw part 48 of the engaging member 20 corresponds to the screw part 70. The screw connection of the screw part 70 with the screw part 48 is achieved.

High accuracy is required for the engagement between the engaging member 20 and the sleeve 10. A golf club function is lost by slight wobbling. High accuracy is required for positioning the engaging member 20. The screw connection of the screw part 70 with the screw part 48 improves the positioning accuracy of the engaging member 20. That is, the engaging member 20 has reduced position error in an axial direction. Furthermore, the engaging member 20 has reduced posture (inclination) error.

Welding is employed to fix the engaging member 20, in addition to the screw connection. That is, the screw connection and the welding are used in combination. At least a part of a boundary surface between the engaging member 20 and the head body 18 is welded, which is not shown in the cross-sectional views of FIGS. 3 and 4. The welding may include the screw connection portion, or may not include the portion. The combined use of the screw connection and the welding ensures the fixation of the engaging member 20. The combined use of the screw connection and the welding prevents the looseness of the screw connection.

Examples of the kind of the welding include laser welding, arc welding, gas welding, and thermite welding. Examples of the arc welding include TIG welding. In the embodiment, the laser welding is employed. A heating range of the laser welding is local. Therefore, the laser welding can suppress deformation caused by heating. When the arc welding (TIG welding or the like) is employed, an opening which leads to the engaging member 20 is formed around the engaging member 20. Welding is performed through the opening.

In the shaft connection state, the engaging member 20 receives the axial force from the screw sc1. The securely fixed engaging member 20 can withstand the axial force from the screw sc1.

The intermediate member 14 is not fixed to the head body 18. In the shaft connection state shown in FIG. 3, the intermediate member 14 abuts on a lower end face of the engaging member 20. Meanwhile, in the shaft separation state shown in FIG. 4, the intermediate member 14 abuts on an upper surface of the flange 30. Thus, the intermediate member 14 can move. The intermediate member 14 can move between the engaging member 20 and the flange 30. Although the intermediate member 14 can move in a predetermined range, the intermediate member 14 cannot be disengaged. The intermediate member 14 may be fixed to the head body 18.

As described above, FIG. 4 shows the shaft separation state. In the shaft separation state, a non-disengaging state where the screw sc1 is not disengaged from the head 4 is enabled. In the non-disengaging state, the screw sc1 suspends from the head 4. The intermediate member 14 causes the achievement of the non-disengaging state. FIG. 4 shows the non-disengaging state.

As shown in FIG. 3, in the shaft connection state, the intermediate member 14 and the screw sc1 are not screw-connected to each other. In the shaft connection state, the non-screw part 64 of the screw sc1 is located inside of the intermediate member 14. An outer diameter of the non-screw part 64 is less than an inner diameter of the inner peripheral surface 56 of the intermediate member 14. In the shaft connection state, the intermediate member 14 does not affect screw connection of the screw sc1 with the sleeve 10. The intermediate member 14 does not hinder the screw connection of the screw sc1 with the sleeve 10.

Meanwhile, as shown in FIG. 4, in the shaft separation state, the intermediate member 14 and the screw sc1 are screw-connected to each other. In the shaft separation state, screw connection of the screw sc1 with the intermediate member 14 can be established.

The shaft separation state is achieved by loosening the screw connection of the sleeve 10 with the screw sc1. In the transition to the shaft separation state, the following steps A to D may occur.

[Step A]: The screw sc1 moves to a sole side in an axial direction in association with the rotation of the screw sc1, to provide the screw connection (screw connection A) of the screw sc1 with the intermediate member 14. In the state where the screw connection A is established, the screw connection of the screw sc1 with the sleeve 10 is released.

[Step B]: When the screw sc1 is further rotated from the state of the step A, the screw connection A is released, and the screw sc1 passes through the intermediate member 14.

[Step C]: The sleeve 10 moves to a grip side in the axial direction in association with the rotation of the screw sc1, and the screw connection of the screw sc1 with the sleeve 10 is released.

[Step D]: When the screw sc1 is further rotated from the state of the step C, the screw connection A of the screw sc1 with the intermediate member 14 is established. When the screw sc1 is further rotated, the screw sc1 passes through the intermediate member 14.

The steps A and B occur when the axial position of the sleeve 10 does not move to the head body 18. In this case, the screw sc1 moves to a sole side in the axial direction by rotating the screw sc1. Meanwhile, the step C occurs when the axial position of the screw sc1 does not move with respect to the head body 18. In this case, the sleeve 10 moves to the grip side by rotating the screw sc1.

In the steps B and D, the screw sc1 can be disengaged from the golf club 2. Meanwhile, in the steps A and C, the screw sc1 is held in the golf club 2 by the intermediate member 14.

The golf club 2 is constituted so that the screw sc1 cannot be screw-connected to the intermediate member 14 in the shaft connection state. Furthermore, the golf club 2 is constituted so that the screw sc1 can be held in the golf club 2 in the shaft separation state. The golf club 2 of the embodiment includes a screw holding mechanism capable of holding the screw sc1 in the shaft separation state. The golf club 2 may not include the screw holding mechanism.

[Second Attaching/Detaching Mechanism]

As shown in FIG. 2, the head 4 includes a socket housing part 72 and a socket 74. The socket housing part 72 is a recess. The socket housing part 72 is formed in a sole of the head 4. The socket 74 is housed in the socket housing part 72. The socket 74 is fixed to the socket housing part 72. The socket 74 is bonded to the socket housing part 72. The weight body wt1 is detachably attached to the socket 74.

The weight body wt1 is detachably attached to the socket 74. Therefore, the weight body wt1 is detachably attached to the head 4. The position of the center of gravity of the head can be changed by replacing the weight body wt1. A head weight can be changed by replacing the weight body wt1.

In the embodiment, the number of socket housing parts 72 is 1. A plurality of socket housing parts 72 may be provided. In the embodiment, the number of sockets 74 is 1. A plurality of sockets 74 may be provided.

Figure 13:
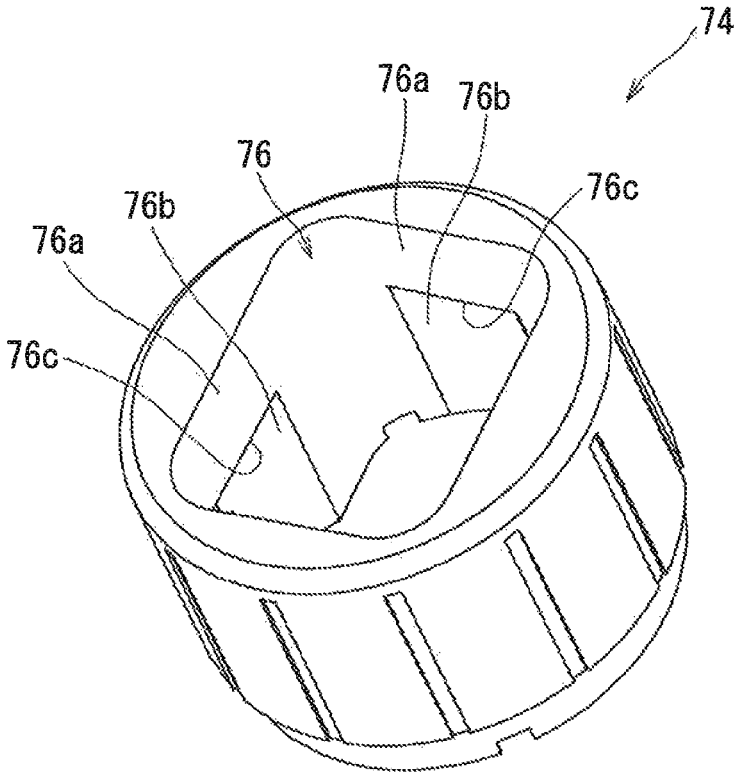
FIG. 13 is a perspective view of the socket.
Figure 14A:
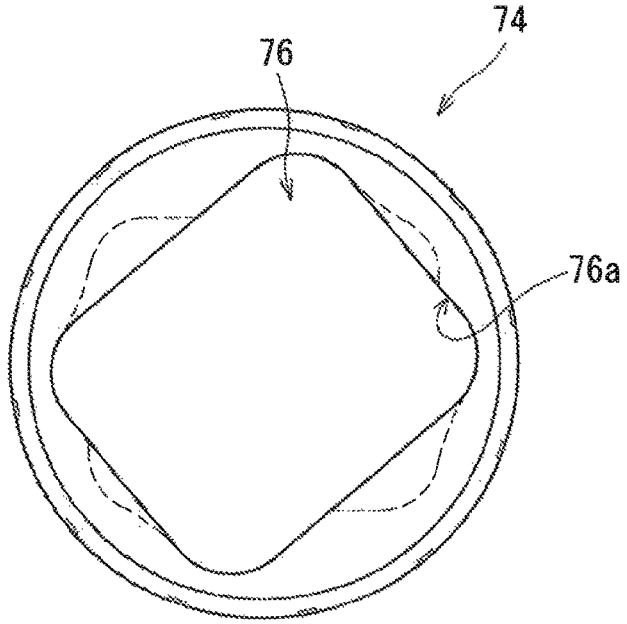
FIG. 14(*a*) is a plan view of the socket of FIG. 13, and FIG. 14(*b*) is a bottom view of the socket of FIG. 13.
Figure 14B:
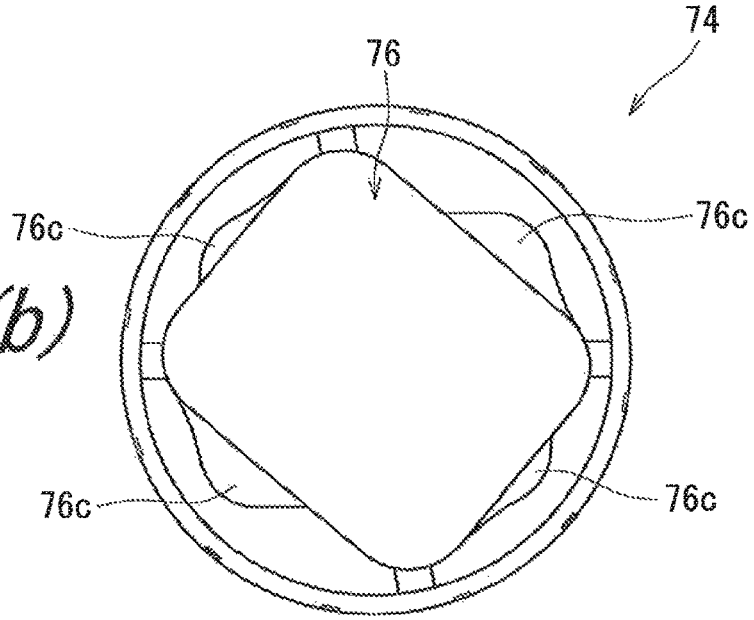

FIG. 13 is a perspective view of the socket 74. FIG. 14 (*a*) is a plan view of the socket 74. FIG. 14(*b*) is a bottom view of the socket 74.

The socket 74 is formed of a polymer. The elastic modulus of the polymer is lower than the elastic modulus of a material forming the head body. Preferably, the socket 74 is made of a resin. A lower hole part 76*b* of the socket 74 can be elastically deformed in association with the rotation of the weight body wt1. In respect of the elastic deformation, the polymer is preferable.

The socket 74 has a hole 76. The hole 76 penetrates the socket 74. The lower side of the hole 76 may be closed.

The hole 76 includes an upper hole part 76*a*, the lower hole part 76*b*, and an engaging bump surface 76*c*. The lower hole part 76*b* is located on a deeper side (lower side) of the upper hole part 76*a*. The engaging bump surface 76*c* is located at the boundary between the upper hole part 76*a* and the lower hole part 76*b*.

As shown in FIG. 14(*a*), the upper hole part 76*a* has a substantially rectangular sectional shape. The substantially rectangular shape is a shape in which four corners of a rectangle are rounded.

Figure 15:
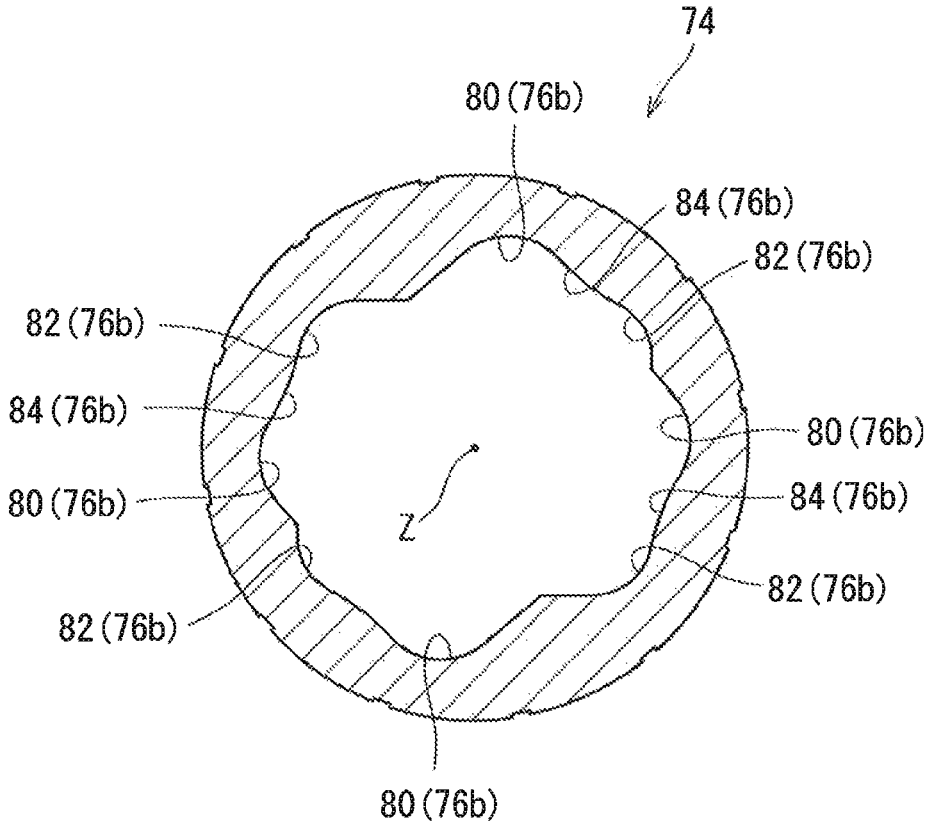
FIG. 15 is a cross-sectional view of the socket of FIG. 13, and is a cross-sectional view in a position where a lower hole part exists.

FIG. 15 is a cross-sectional view of the socket 74. The axial position of the cross-sectional view is a position where the lower hole part 76*b* is present. As shown in FIG. 15, the sectional shape of the lower hole part 76*b* has complicated unevenness. The sectional shape of the lower hole part 76*b* is different from the sectional shape of the upper hole part 76*a*. Because of the difference, the engaging bump surface 76*c* is formed (See FIG. 14 (*b*)). The engaging bump surface 76*c* is a downward surface.

As shown in FIG. 15, the lower hole part 76*b* includes a non-engaging corresponding surface 80, an engaging corresponding surface 82, and a resistance surface 84. The resistance surface 84 is located between the non-engaging corresponding surface 80 and the engaging corresponding surface 82.

Figure 16:
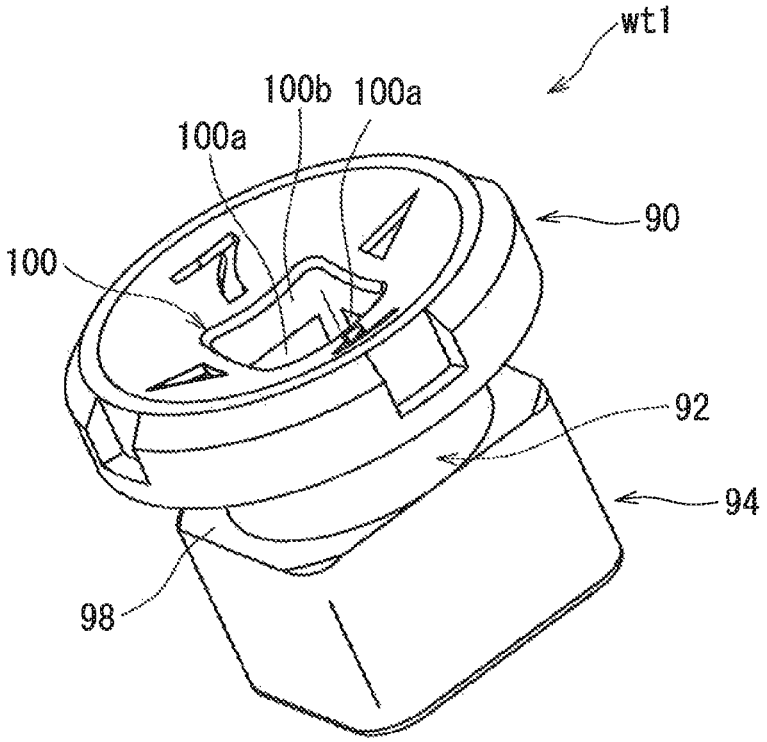
FIG. 16 is a perspective view of a weight body.
Figure 17A:
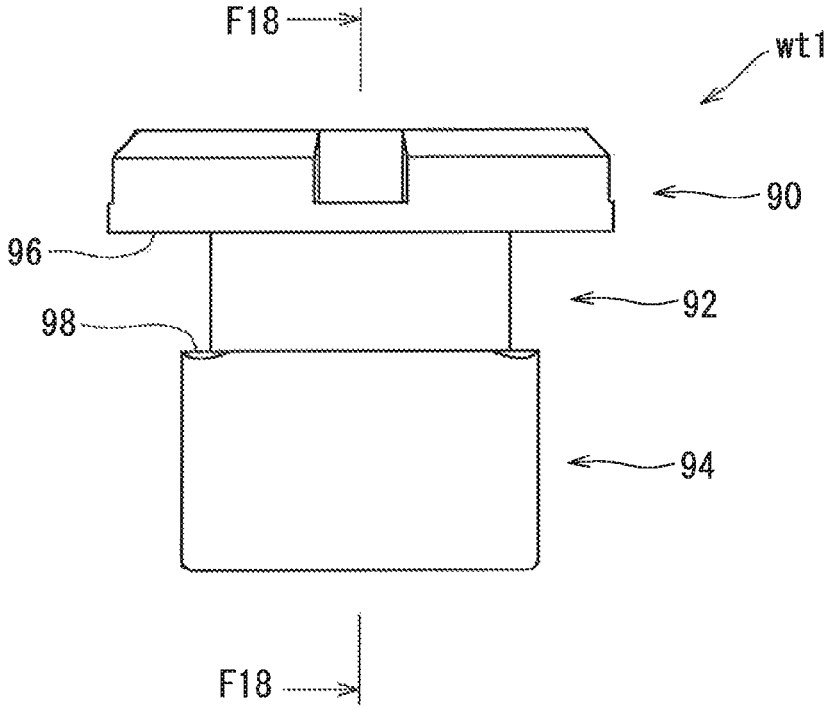
FIG. 17(*a*) is a side view of the weight body of FIG. 16, and FIG. 17(*b*) is a side view of the weight body from another point of view.
Figure 17B:
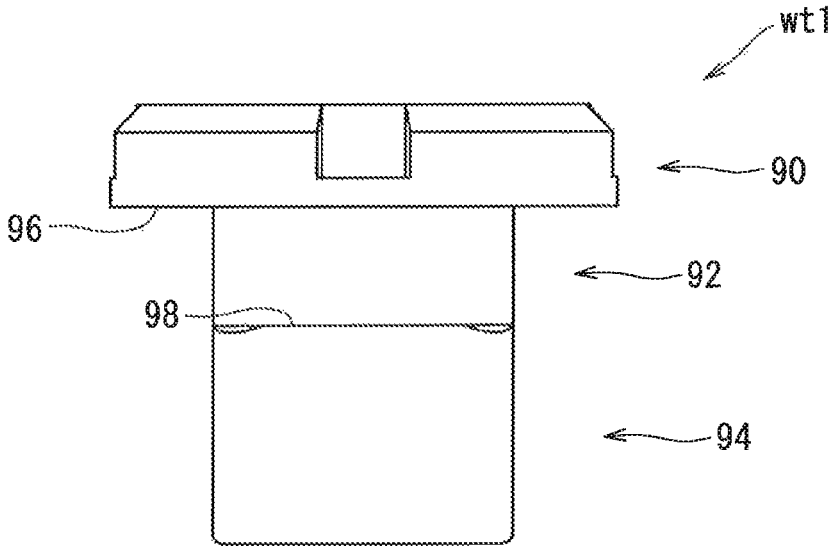
Figure 18:
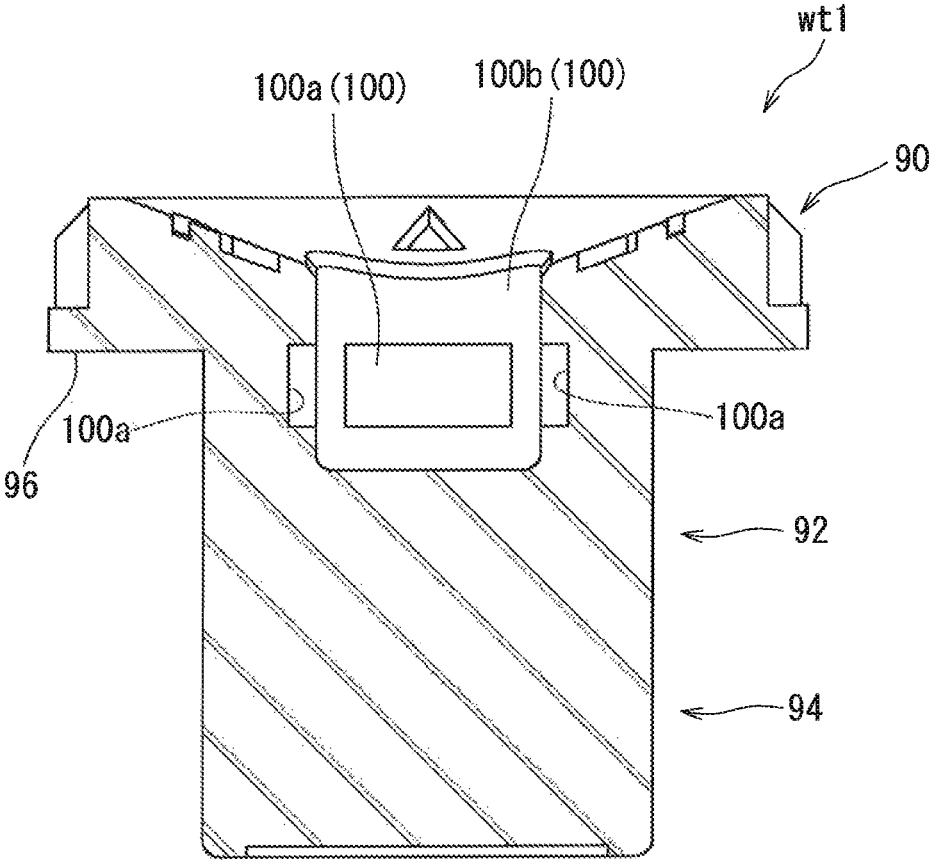
FIG. 18 is a cross-sectional view of the weight body of FIG. 16.

FIG. 16 is a perspective view of the weight body wt1. FIGS. 17 (*a*) and 17 (*b*) are side views of the weight body wt1. A point of view in FIG. 17(*a*) is different by 90 degrees from a point of view in FIG. 17 (*b*). FIG. 18 is a cross-sectional view taken along line F18-F18 of FIG. 17(*a*).

The specific gravity of the weight body wt1 may be greater than the specific gravity of the head body. The specific gravity of the weight body wt1 is preferably greater than the specific gravity of the socket 74. In respects of durability and a specific gravity, the weight body wt1 is preferably made of a metal. Examples of the metal include aluminum, an aluminum alloy, titanium, a titanium alloy, stainless steel, a tungsten alloy, and a tungsten nickel alloy (W—Ni alloy). An example of the titanium alloy is 6-4Ti (Ti-6Al-4V). An example of the stainless steel is SUS304.

The weight body wt1 includes a head part 90, a neck part 92, and an engaging part 94. An upper surface of the head part 90 is exposed to the outside in a state where the weight body wt1 is fixed to the socket 74. An outer surface of the neck part 92 is a circumferential surface. The neck part 92 has a cylindrical shape.

Figure 20:
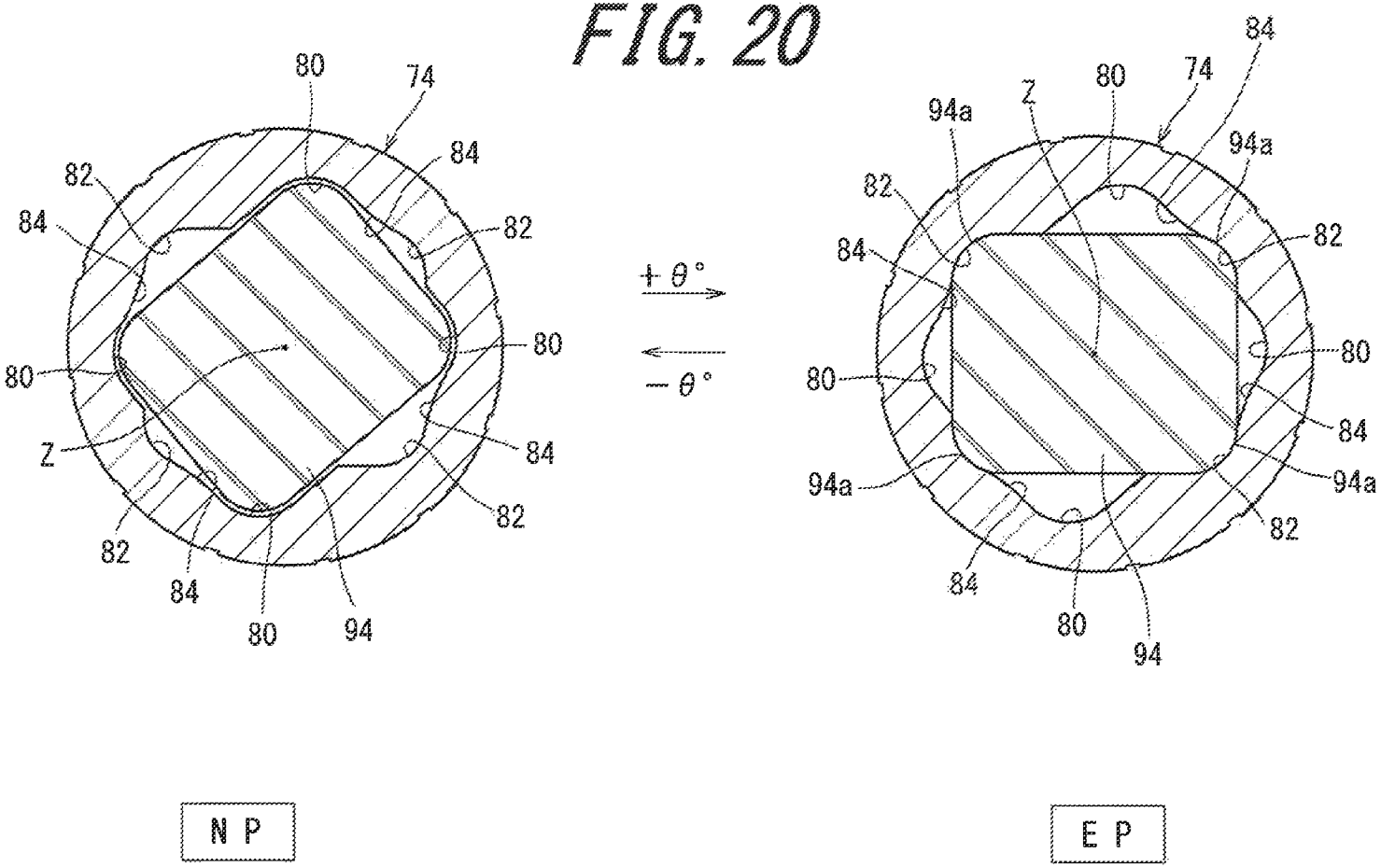
FIG. 20 is a cross-sectional view corresponding to FIG. 19.

An outer surface of the engaging part 94 has a non-circular sectional shape. As shown in FIG. 20 described later, in the embodiment, the sectional shape is a substantially rectangular shape. The sectional shape of the engaging part 94 has a similarity relationship with the sectional shape of the upper hole part 76*a*. The sectional shape of the engaging part 94 is (slightly) smaller than the sectional shape of the upper hole part 76*a*. The engaging part 94 can pass through the upper hole part 76*a*.

As shown in FIGS. 17 (*a*) and 17 (*b*), the head part 90 includes a lower surface 96. The engaging part 94 includes an engaging surface 98. The engaging surface 98 is formed by a difference between the sectional shapes of the engaging part 94 and the neck part 92. The engaging surface 98 is an upward surface. The engaging surface 98 is opposed to the lower surface 96.

A tool inserting part 100 is formed in the head part 90. The tool inserting part 100 is a hole having a non-circular sectional shape. The shape of the hole is adapted into the tool 102. The tool inserting part 100 is formed in the center of an upper end face of the head part 90.

As shown in FIG. 18, an engaging part 100*a* is formed in an inner surface of the tool inserting part 100. In the embodiment, the engaging part 100*a* is a recess. Four engaging parts 100*a* are formed.

The tool inserting part 100 has a quadrangular sectional shape. The tool inserting part 100 includes four planes 100*b* so as to correspond to the quadrangular shape. The engaging part 100*a* is formed in each of these planes 100*b*. When the tool inserting part 100 has an n-polygonal sectional shape, and includes n planes 100*b*, the engaging part 100*a* is preferably formed in each of these n planes 100*b*. n is a natural number equal to or greater than 3. n is preferably equal to or less than 12, and more preferably equal to or less than 8. n is particularly preferably 4, 6, or 8. The n-polygon is preferably a regular n-polygon.

Figure 19:
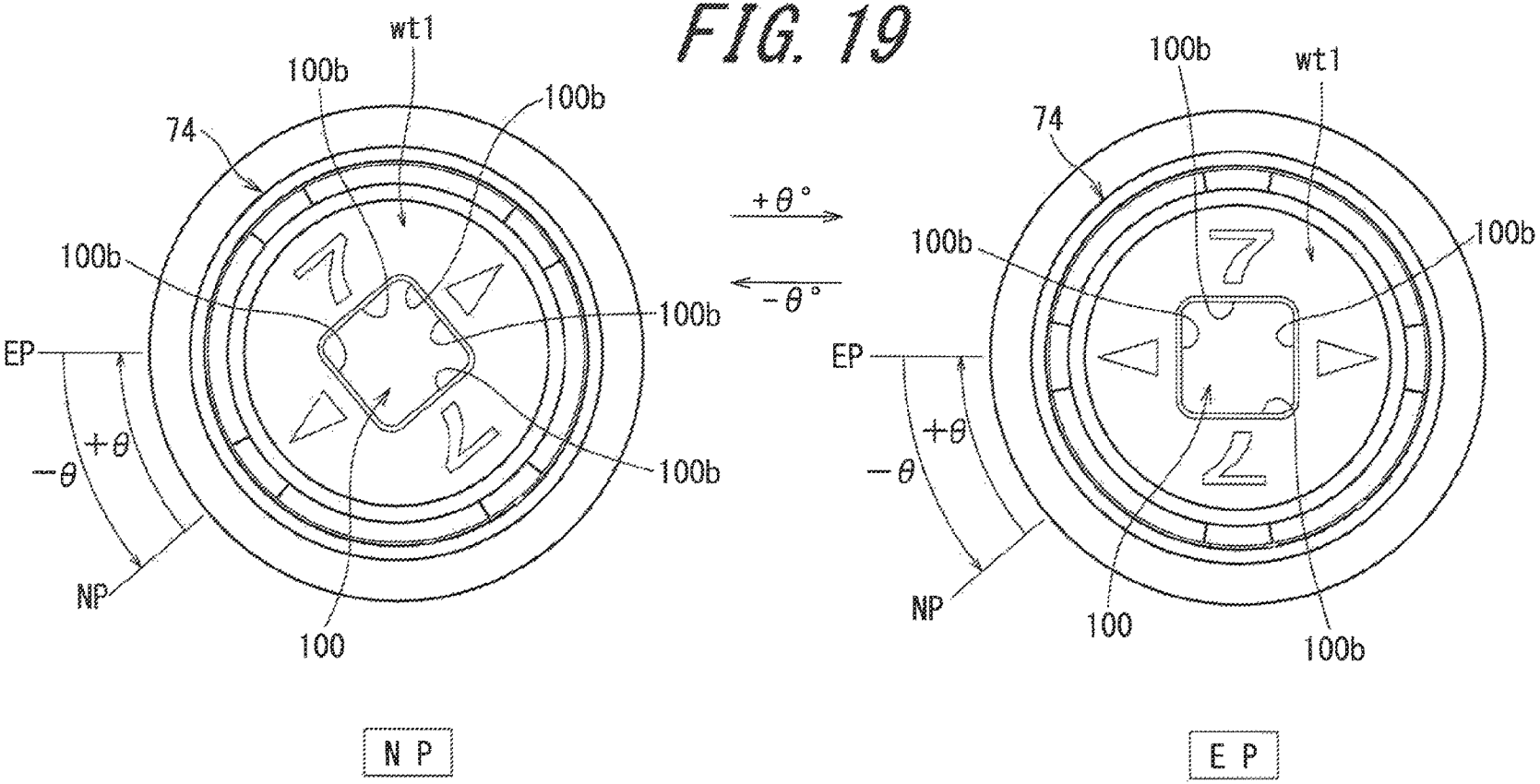
FIG. 19 is a plan view showing the mutual transition of an engaging position and a non-engaging position.

FIG. 19 is a plan view of the weight body wt1 inserted into the socket 74. FIG. 19 shows the mutual transition between an engaging position EP and a non-engaging position NP.

When the weight body wt1 is attached to the socket 74, the weight body wt1 is first inserted into the hole 76. When the weight body wt1 is inserted into the hole 76, the engaging part 94 passes through the upper hole part 76*a*, and reaches the lower hole part 76*b*. At this time, the weight body wt1 is located at the non-engaging position NP. The non-engaging position NP is in an unlock state. Next, the weight body wt1 is axially rotated. The angle of the axial rotation is θ (degree). The angle θ is less than 360 degrees. The transition to the engaging position EP from the non-engaging position NP is achieved by the rotation. The engaging position EP is in a lock state.

FIG. 20 shows cross-sectional views of the non-engaging position NP and the engaging position EP. The lower hole part 76*b* and the engaging part 94 are shown in these cross-sectional views. In the mutual transition of the non-engaging position NP and the engaging position EP, the weight body wt1 is rotated about an axis line Z.

As described above, the lower hole part 76*b* includes the non-engaging corresponding surface 80, the engaging corresponding surface 82, and the resistance surface 84. The non-engaging corresponding surface 80 is a surface corresponding to the engaging part 94 at the non-engaging position NP. The engaging corresponding surface 82 is a surface corresponding to the engaging part 94 at the engaging position EP.

The resistance surface 84 is pressed by a corner part 94*a* of the engaging part 94 during the mutual transition between the non-engaging position NP and the engaging position EP. A frictional force is generated between the engaging part 94 and the lower hole part 76*b* by the pressing. Simultaneously, the resistance surface 84 is compressively deformed by the pressing. In the mutual transition, the corner part 94*a* goes over the resistance surface 84 while compressively deforming the resistance surface 84.

The frictional force generates a rotation resistance. A comparatively strong torque is required for the mutual transition of the non-engaging position NP and the engaging position EP due to the rotation resistance. The mutual transition does not easily take place. The mutual transition is not generated by an impact force in hitting. The tool 102 (described later) is required for the mutual transition. The mutual transition cannot be attained with empty hands without using the tool 102. The weight body wt1 located at the engaging position EP is not separated by strong impact shock in hitting.

As shown in FIG. 20, the resistance surface 84 forms a convex-like part. The convex-like part is formed by a smooth curved surface. The rotation resistance is increased by the convex-like part. The convex-like part prevents the removal of the weight body wt1 located at the engaging position EP. Thus, the weight body wt1 is securely attached by the rotation (positive rotation) of an angle +θ. Furthermore, the weight body wt1 can be easily detached by the rotation (negative rotation) of an angle −θ.

The angle of the relative rotation for making the transition to the engaging position EP from the non-engaging position NP is also described as "+θ" in the present application. The angle of the relative rotation for making the transition to the non-engaging position NP from the engaging position EP is also described as "−θ" in the present application. Reference characters of "+" and "−" are applied in order to show that rotation directions are opposite to each other.

In the embodiment, the angle θ is 40 degrees. In respect of the certainty of the fixation, the angle θ is preferably equal to or greater than 20 degrees, and more preferably equal to or greater than 30 degrees. In respect of the easiness of attachment and detachment, the angle θ is preferably equal to or less than 60 degrees, and more preferably equal to or less than 50 degrees.

Figure 21:
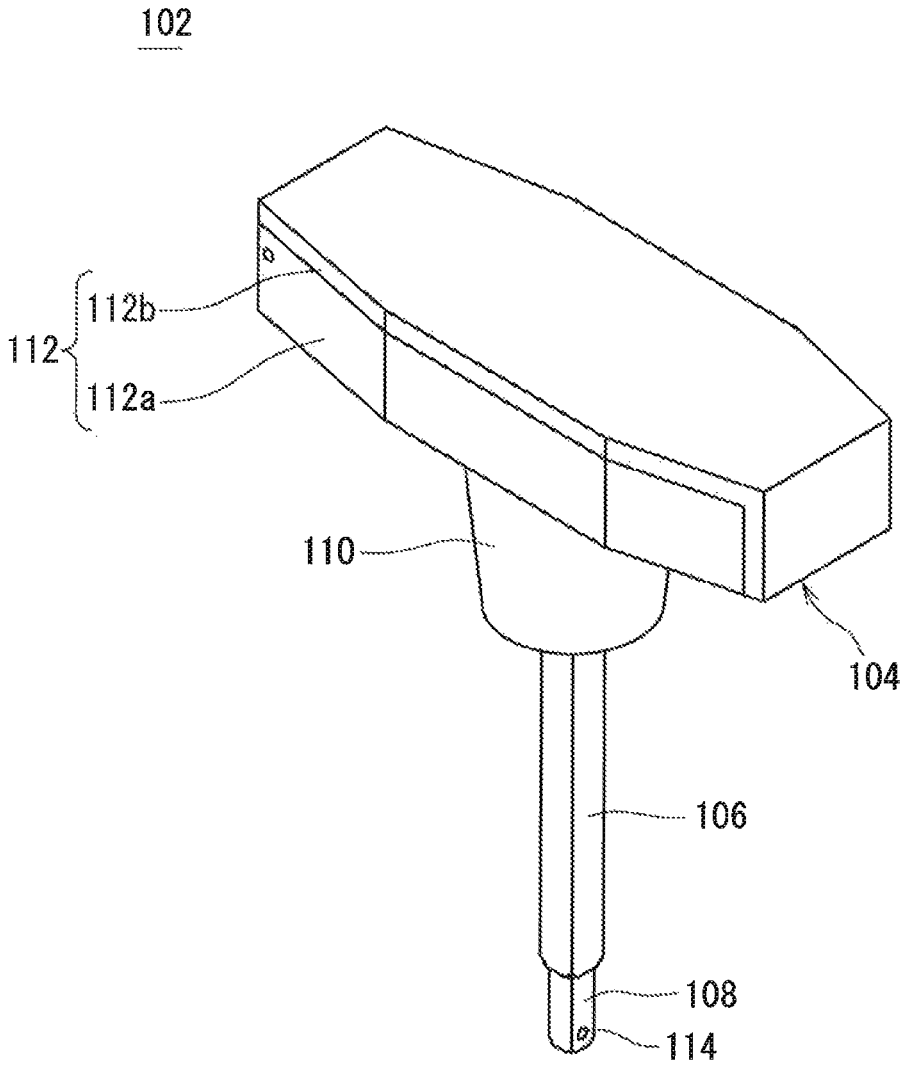
FIG. 21 is a perspective view showing an example of a tool.

One tool is used to rotate the weight body wt1 and the screw sc1. FIG. 21 is a perspective view showing an example of the tool 102. The tool 102 is a torque wrench. The tool 102 includes a handle 104, a shaft 106, and a tip part 108. The shaft 106 is coaxial with the tip part 108. The handle 104 includes a shaft supporting part 110 and a holding part 112. The holding part 112 includes a holding part body 112*a* and a lid 112*b*. A back end part of the shaft 106 is fixed to the shaft supporting part 110. In the embodiment, the tip part 108 has a quadrangular sectional shape.

The sectional shape of the tip part 108 corresponds to the sectional shape of the tool inserting part 100 of the weight body wt1. The tip part 108 can be inserted into the tool inserting part 100.

The sectional shape of the tip part 108 corresponds to the sectional shape of the tool inserting part 66 of the screw sc1. The tip part 108 can be inserted into the tool inserting part 66.

The tool 102 is used to rotate the weight body wt1. Furthermore, the tool 102 can be used also to rotate the screw sc1. The common tool 102 can rotate both the weight body wt1 and the screw sc1.

The tool 102 includes a projection part 114. The projection part 114 is provided on the tip part 108. The tip part 108 has a quadrangular sectional shape. The side surfaces of the tip part 108 are four planes. The projection part 114 is provided on one of these planes. The tip of the projection part 114 is a convex curved-surface.

The projection part 114 is biased in a projection direction. The projection part 114 is projected in a state where it can retract. Although not shown in the drawings, a biasing part is built in the tip part 108. The biasing part is an elastic body. More specifically, the biasing part is a coil spring. The biasing part biases the projection part 114 in the projection direction. Although the projection part 114 can move in a projecting direction and a retracting direction, the projection part 114 is always biased in the projection direction. When the tool 102 is in a natural state, the projection height of the projection part 114 is the maximum. The natural state means a state where an external force does not act on the projection part 114.

When the projection part 114 is pressed against the biasing, the projection part 114 can retract. The projection part 114 can retract to a position where the projection height is zero.

When the tool 102 is used, the lid 112*b* is closed. A weight body housing part (not shown) is provided in the holding part body 112*a*. Preferably, the weight body housing part can house a plurality of weight bodies wt1. A plurality of weight bodies wt1 having different weights are preferably housed. The housed weight bodies wt1 can be taken out by opening the lid 112*b*.

Figure 22:
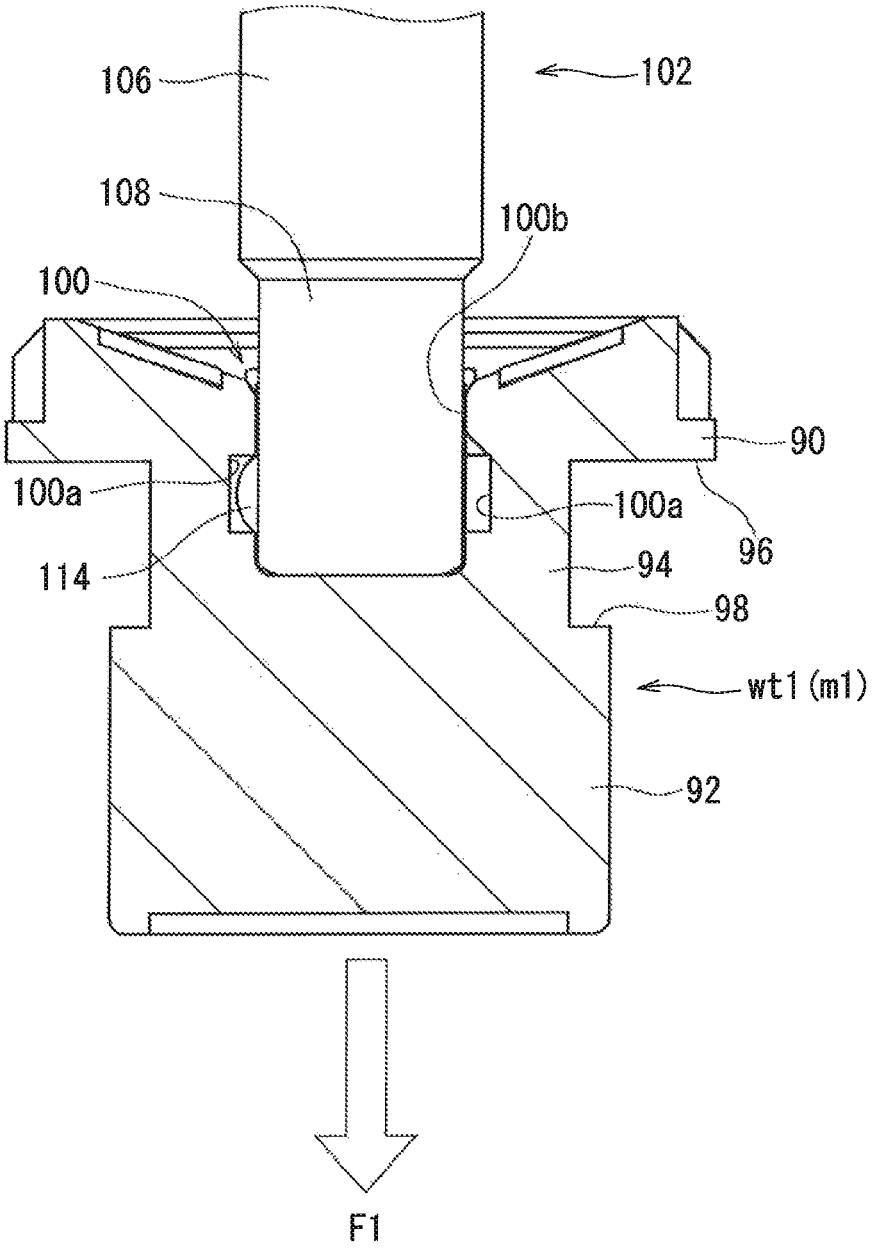
FIG. 22 is a cross-sectional view showing a connection state of the tool and a first member.

FIG. 22 is a cross-sectional view showing a state where the tool 102 is used for the weight body wt1. The tip part 108 of the tool 102 is inserted into the tool inserting part 100 of the weight body wt1 when the tool 102 is used for the weight body wt1. The projection part 114 is pressed by the plane 100*b* of the tool inserting part 100 at the initial stage of the insertion. The projection part 114 presses the plane 100*b* while retracting. When the insertion further advances, the projection part 114 reaches the position of the engaging part 100*a*. The projection part 114 enters into the engaging part 100*a* at the position (see FIG. 22). The engagement (engagement A) between the projection part 114 and the engaging part 100*a* is achieved by the entering. Due to the engagement A, the weight body wt1 is less likely to be disengaged from the tool 102.

As shown in FIG. 22, when the tool 102 is maximally inserted, the projection part 114 enters into the engaging part 100*a*. That is, when the tool 102 is maximally inserted, the engagement A is achieved.

At the engaging position EP, the weight body wt1 cannot be extracted from the hole 76 of the socket 74. This is because the engaging bump surface 76*c* is engaged with the engaging surface 98 of the weight body wt1 at the engaging position EP. Therefore, at the engaging position EP, the extraction of the tool 102 which involves the release of the engagement A is easily performed. In respect of the easiness of the extraction which involves the release of the engagement A, The force F1 is preferably less than gravity acting on the golf club 2. In this case, the tool 102 can be extracted from the weight body wt1 under own weight of the golf club 2.

Figure 23:
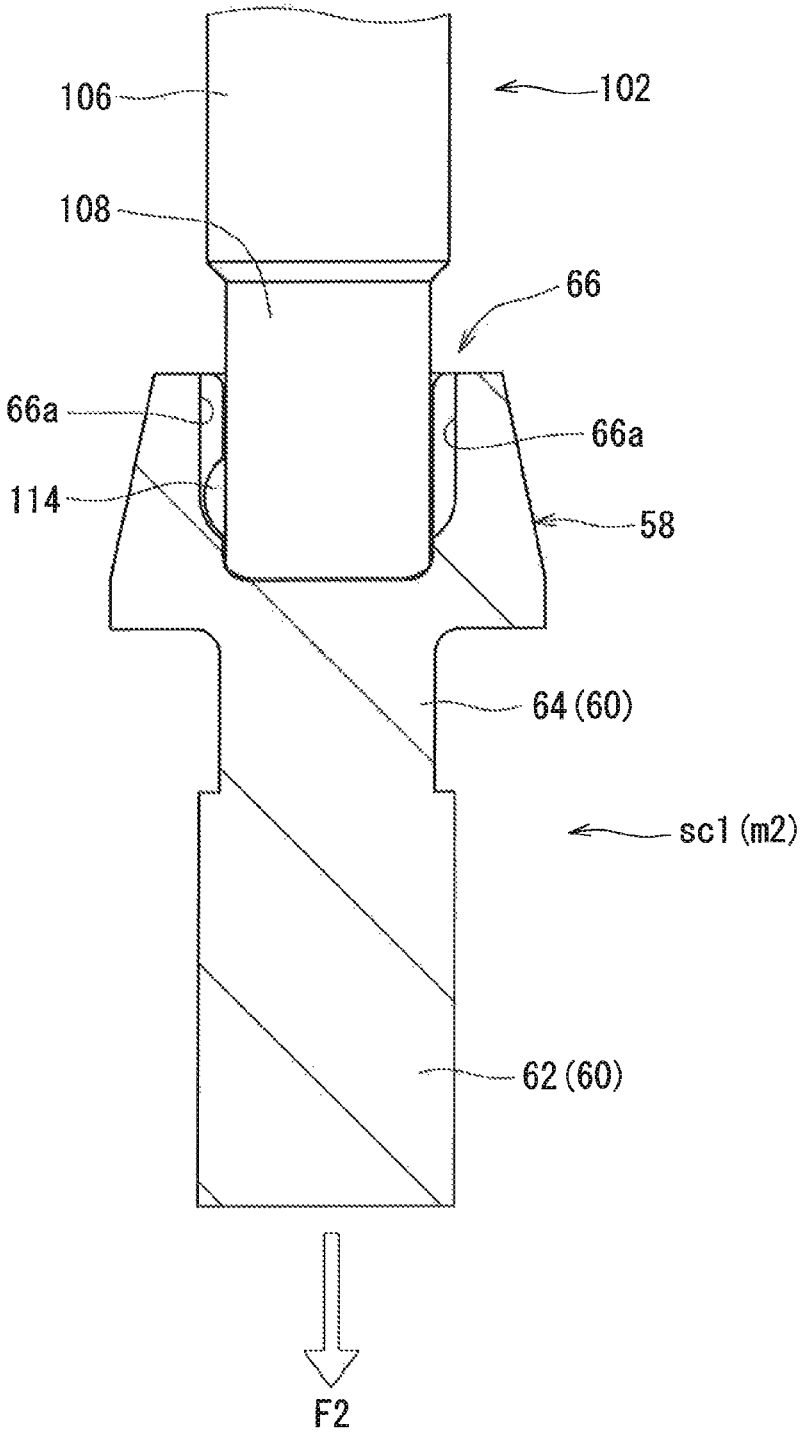
FIG. 23 is a cross-sectional view showing a connection state of the tool and a second member.

FIG. 23 is a cross-sectional view showing a state where the tool 102 is used for the screw sc1. A screw thread is omitted in FIG. 23.

As shown in FIG. 23, the tip part 108 of the tool 102 is inserted into the tool inserting part 66 of the screw sc1 when the tool 102 is used for the screw sc1. The projection part 114 is located in the avoiding part 66*a* when the tool 102 is inserted. The avoiding part 66*a* is provided at a position corresponding to the projection part 114. Regardless of the position of the tool 102 in an insertion direction, the projection part 114 is located in the avoiding part 66*a*. Due to the avoiding part 66*a*, the projection part 114 is not engaged with the tool inserting part 66. Due to the avoiding part 66*a*, the non-engagement (non-engagement B) between the projection part 114 and the tool inserting part 66 is achieved. Due to the non-engagement B, the screw sc1 is likely to be disengaged from the tool 102.

The avoiding part 66*a* may not completely avoid the engagement with the projection part 114 (holding mechanism). For example, the groove depth of the avoiding part 66*a* may be less than the maximum projection height of the projection part 114. Even the imperfect avoidance is effective in decreasing the force F2. Preferably, as in the embodiment, the perfect avoidance is achieved. The force F2 may be made zero by the perfect avoidance. In the embodiment, the groove depth of the avoiding part 66*a* is greater than the maximum projection height of the projection part 114.

[First Member]

The golf club according to the present application includes a first member detachably attached. The first member is attached to any position of the golf club. The attaching position of the first member is not limited. The first member may be attached to the head. The first member may be attached to the sole of the head as in the weight body wt1 described above. The first member may be attached to the shaft. The first member may be attached to the grip.

A tool is used to attach and detach the first member. The first member is adapted into the tool. The first member can be axially rotated by using the tool. The tool can apply a rotation torque greater than a rotation torque caused by empty hands to the first member. The tool 102 is an example of the tool.

The weight body wt1 is an example of the first member. An example of the first member is the weight body wt1 detachably attached to the socket 74. Examples of the first member include a face angle adjusting member, in addition to the weight body wt1. The face angle adjusting member can be fixed at a plurality of positions on the sole. The face angle (hook angle) of the club varies according to the fixing positions of the face angle adjusting member.

The attaching/detaching mechanism of the weight body wt1 is as described above. In addition, examples of the attaching/detaching mechanism of the first member include a screw mechanism.

A plurality of the first members may be provided. The number of the first members may be 1, or equal to or greater than 2. For example, a plurality of weight bodies may be detachably attached to the sole, and all the weight bodies may be the first member.

[Second Member]

The golf club according to the present application includes a second member detachably attached. The second member is a member different from the first member. The second member is attached to any position of the golf club. The attaching position of the second member is not limited. The second member may be attached to the head. The second member may be attached to the sole of the head as in the screw sc1 described above. The second member may be attached to the shaft. The second member may be attached to the grip.

A tool is used to attach and detach the second member. The tool is the same as the tool used for the first member. That is, one tool is adapted into both the first member and the second member. The second member may be axially rotated by using the tool. The tool can apply a rotation torque greater than a rotation torque caused by empty hands to the second member. The tool 102 is an example of the tool.

The screw sc1 is an example of the second member. An example of the second member is the screw sc1 capable of fixing the sleeve 10 to the head 4. Examples of the second member include a weight body and a face angle adjusting member, in addition to the screw sc1. For example, in the head including the two weight bodies, the first weight body may be the first member, and the second weight body may be the second member. For example, in the head including the weight body and the face angle adjusting member, the weight body may be the first member, and the face angle adjusting member may be the second member.

An example of the face angle adjusting member includes a projection part projected from a sole surface, and the projection height of the projection part from the sole surface can be adjusted. The face angle can vary based on the projection height. The projection height can be adjusted by fastening and loosening the screw connection.

Another example of the face angle adjusting member includes a projection part capable of moving on a sole surface, and the position of the projection part can be adjusted. The face angle can vary based on the position of the projection part. The projection part can be fixed and moved by fastening and loosening the screw connection.

In the embodiment, the screw sc1 as the second member can be screw-connected to the sleeve 10. The shaft-sleeve assembly 12 is fixed to the head 4 by the screw connection.

A plurality of the second members may be provided. The number of second member may be 1, or equal to or greater than 2. For example, in the golf club including the screw sc1, a plurality of weight bodies may be detachably attached to the sole; at least one of the weight bodies and the screw sc1 may be the second member, and the other weight body may be the first member.

[F1, F2]

The difference between the first member and the second member exists in the easiness of withdrawal from the tool. Indexes representing the easiness of withdrawal are the forces F1 and F2. The force F1 is the minimum force required to detach the first member from the tool. The force F2 is the minimum force required to detach the second member from the tool.

The direction of the force F1 is the most suitable direction for removing the first member from the tool. The direction of the force F2 is the most suitable direction for removing the second member from the tool.

A "connection state" is defined in the present application for the evaluation of the forces F1 and F2. The connection state means a state where the member is most likely to be separated from the tool. A state where the first member is most likely to be separated from the tool is a first connection state described later. A state where the second member is most likely to be separated from the tool is a second connection state described later.

[First Connection State, Force F1]

FIG. 22 shows a connection state (first connection state) of the tool 102 and a first member m1. In the first connection state, the tip part 108 of the tool 102 is coaxial with the tool inserting part 100 of the first member m1 (weight body wt1). In the first connection state, the center axis line of the tip part 108 (shaft 106) is set in the vertical direction. In the first connection state, the center axis line of the tool inserting part 100 (recess) is set in the vertical direction. In the first connection state, the first member m1 (weight body wt1) is disposed below the tool 102 in the vertical direction.

In the first connection state, the insertion direction of the tool 102 coincides with the vertical direction. In the first connection state, the first member m1 (weight body wt1) is most likely to be withdrawn from the tool 102. In this state, the force F1 is evaluated. The unit of the force F1 is kgf, for example. The direction of the force F1 is downward in the vertical direction.

As shown in FIG. 22, the direction of the force F1 is downward in the vertical direction. Gravity (own weight of the first member m1) acting on the first member m1 is also included in the force F1.

When the gravity acting on the first member m1 is greater than the force F1, the first member m1 is naturally disengaged from the tool 102. In the embodiment, the gravity acting on the first member m1 is less than the force F1. Therefore, the first member m1 is not disengaged under the first member's own weight from the tool 102.

[Second Connection State, Force F2]

FIG. 23 shows a connection state (second connection state) of the tool 102 and a second member m2. In the second connection state, the tip part 108 of the tool 102 is coaxial with the tool inserting part 66 of the second member m2 (screw sc1). In the second connection state, the center axis line of the tip part 108 (shaft 106) is set in the vertical direction. In the second connection state, the center axis line of the tool inserting part 66 (recess) is set in the vertical direction. In the second connection state, the second member m2 (screw sc1) is disposed below the tool 102 in the vertical direction.

In the second connection state, the insertion direction of the tool 102 coincides with the vertical direction. In the second connection state, the second member m2 (screw sc1) is most likely to be withdrawn from the tool 102. In this state, the force F2 is evaluated. The unit of the force F2 is kgf, for example. The direction of the force F2 is downward in the vertical direction.

As shown in FIG. 23, the direction of the force F2 is downward in the vertical direction. Gravity (own weight of the second member m2) acting on the second member m2 is also included in the force F2.

When the gravity acting on the second member m2 is greater than the force F2, the second member m2 is naturally disengaged from the tool 102. In the embodiment, the gravity acting on the second member m2 is greater than the force F2. Therefore, the second member m2 is disengaged under the second member's own weight from the tool 102.

The engagement A increases the force F1. Meanwhile, the non-engagement B decreases the force F2. In the embodiment, the force F1 is greater than the force F2.

In the embodiment, F1 is differentiated from F2 according to the roles of the first member m1 and the second member m2. For this reason, the operativity of each member can be improved. The plurality of members m1 and m2 can be operated by one tool 102.

[Holding Mechanism]

The holding mechanism means a mechanism capable of increasing the force F1. The holding mechanism in the embodiment is the projection part 114 biased in the projection direction. As in the embodiment, the tool 102 may include the holding mechanism. The first member m1 may include the holding mechanism. Preferably, the first member m1 (weight body wt1) includes the engaging part 100*a* capable of being engaged with the holding mechanism (projection part 114). The engaging part 100*a* can further increase the force F1. Preferably, the second member m2 (screw sc1) includes the avoiding part 66*a* capable of avoiding the engagement with the holding mechanism (projection part 114).

[Constitution for Achieving F1>F2]

In the embodiment, the force F1 is greater than the force F2. Examples of the constitution for achieving the relationship include the following constitutions.

[Constitution 1]: The tool 102 includes the holding mechanism (projection part 114); the first member m1 includes the engaging part 100*a*; and the second member m2 includes the avoiding part 66*a*.

[Constitution 2]: The tool 102 includes the holding mechanism (projection part 114); the first member m1 includes the engaging part 100*a*; and the second member m2 includes no avoiding part 66*a*.

[Constitution 3]: The tool 102 includes the holding mechanism (projection part 114); the first member m1 includes no engaging part 100*a*; and the second member m2 includes the avoiding part 66*a*.

[Constitution 4]: The tool 102 includes no projection part 114; the first member m1 includes no engaging part 100*a*; and the second member m2 includes no avoiding part 66*a*. The hole size of the tool inserting part 100 of the first member m1 is (slightly) less than the hole size of the tool inserting part 66 of the second member m2.

[Constitution 5]: The tool 102 includes no holding mechanism (projection part 114), and the first member m1 includes the holding mechanism.

[Constitution 6]: A magnetic force is generated between the tool 102 and the first member m1 in the first connection state, and a magnetic force is not generated between the tool 102 and the second member m2 in the second connection state.

Example of the constitution 1 is the golf club of the embodiment. Example of the constitution 2 is the same golf club as the golf club of the embodiment except that the tool inserting part 66 includes no avoiding part 66*a* and a portion corresponding to the avoiding part 66*a* is flat. Example of the constitution 3 is the same golf club as the golf club of the embodiment except that the tool inserting part 100 includes no engaging part 100*a* and a portion corresponding to the engaging part 100*a* is flat. In the constitution 6, F1>F2 is achieved by the magnetic force. The holding mechanism using the magnetic force is employed in the constitution 6.

In respect of increasing the difference between the force F1 and the force F2, the constitutions 1, 2, and 3 are preferable; the constitutions 1 and 3 are more preferable; and the constitution 1 is still more preferable.

Preferably, the first member m1 is a replaceable member. Preferably, the first member m1 is a member capable of fulfilling its function when the first member m1 is replaced. The weight body wt1 is a member capable of fulfilling its function when the weight body wt1 is replaced. Examples of the function include a change in the head weight and a change in a position of the center of gravity of the head. Preferably, the golf club 2 further includes a weight body wt1 for replacement. Preferably, the golf club 2 includes a first weight body wt1 and a second weight body wt2 having a weight different from the weight of the first weight body wt1.

The increased force F1 means that the holding property of the first member m1 by the tool 102 is high. When the first member m1 is replaced, the weight body wt1 before replacing is taken out from the head 4 (golf club 2). The first member m1 is easily taken out by the holding property.

The weight body wt1 held by the tip of the tool 102 is easily extracted from the socket 74 by using the tool 102. The weight body wt1 making the transition to the non-engaging position NP by the rotation of $-\theta°$ is taken out as it is by the tool 102. The holding property enables the insertion of the weight body wt1 into the socket 74 using the tool 102. The golf club 2 has excellent replacing workability of the first member m1 (weight body wt1). The golf club 2 has excellent handling property of the first member m1.

Preferably, the second member m2 is a member which may not be separated from the golf club 2. Preferably, the second member m2 is a member requiring no replacement. Preferably, the second member m2 is a member fulfilling its function even when the second member m2 is not replaced. Preferably, the second member m2 is a member capable of fulfilling its function (attachment and detachment of the shaft 6) even when the second member m2 is not separated from the golf club 2.

As shown in FIG. 4, in the golf club 2, the shaft separation state can be produced in a state where the screw sc1 is not separated from the head 4. That is, in the golf club 2, the shaft 6 including the sleeve 10 can be separated from the head 4 in a state where the screw sc1 is not separated from the head 4.

The screw sc1 is a member capable of fulfilling its function even when the screw sc1 is not separated from the golf club 2. The screw sc1 does not need to be separated from the golf club 2. When the screw sc1 is separated from the golf club 2, work (reattaching work) for attaching the screw sc1 to the golf club 2 is required again. The work is preferably omitted. The screw sc1 may be lost by separating the screw sc1. The loss is preferably suppressed.

Since the force F2 is decreased in the golf club 2, the screw sc1 is less likely to be held by the tool 102. Therefore, a situation where the screw sc1 is taken out from the golf club 2 without user's intentions is less likely to be generated. In the golf club 2, the need of the reattaching work is suppressed. In the golf club 2, the loss of the screw sc1 is suppressed. The golf club 2 has excellent handling property of the screw sc1 (second member m2).

As shown in FIG. 4, the screw sc1 is not separated from the golf club 2 as long as the screw sc1 is connected to the intermediate member 14. However, in work for loosening the screw sc1, the combination of the screw sc1 with the intermediate member 14 may be released. The release may be achieved when the screw sc1 is excessively turned. As a result, the screw sc1 is in a state where the screw sc1 can be disengaged. Even in this state, the screw sc1 is less likely to be held by the tool 102.

When the screw sc1 is operated, in the posture of the golf club 2, the head 4 is usually located on an upper side while the grip 8 is located on a lower side. For example, the tool 102 is inserted from above in a state where a grip end of the golf club 2 abuts on the ground, and the screw sc1 is rotated. In this case, as shown in FIG. 23, the screw sc1 is located below the tool 102. Even when the screw sc1 is in a state where the screw sc1 can be disengaged, the screw sc1 is detached under its own weight from the tool 102. For this reason, a situation where the screw sc1 is disengaged from the golf club 2 without user's intentions is less likely to be generated. Therefore, the screw sc1 is less likely to be lost.

In respects of preventing the loss of the screw sc1 or the like, and of preventing the need of the reattaching work, the screw sc1 is preferably held in the golf club 2 in the shaft separation state. In this respect, it is preferable that the steps B and D do not occur. In other words, the work for loosening the screw sc1 is preferably ended when the shaft separation state is achieved. When the shaft separation state is achieved, the screw sc1 is released from the restriction caused by the sleeve 10. In the state where the screw sc1 is released, the screw sc1 is preferably separated from the tool 102. In this respect, the screw sc1 is preferably separated under its own weight from the tool 102. In the screw sc1, the occurrence of the steps B and D can be effectively suppressed.

Thus, the screw sc1 is likely to be separated from the tool 102 by decreasing the force F2. As a result, the screw sc1 is likely to stay in the head 4, and the disengagement and loss of the screw sc1 are less likely to occur. Furthermore, as described above, the intermediate member 14 can cause the achievement of the non-disengaging state of the screw sc1. The disengagement and loss of the screw sc1 are effectively suppressed by these synergistic effects. The golf club has excellent handling property of the screw sc1.

In light of the handling property, it is preferable that the first member m1 (weight body wt1) is not naturally disengaged from the tool 102. When gravity acting on the first member m1 is defined as M1 (kgf), a ratio (F1/M1) is preferably equal to or greater than 1, more preferably equal to or greater than 1.5, and still more preferably equal to or greater than 2. In respect of preventing excessive F1, the ratio (F1/M1) is preferably equal to or less than 10, and more preferably equal to or less than 9. In light of the workability when the tool 102 is extracted from the first member m1, the force F1 is preferably less than the gravity acting on the golf club 2.

In light of the handling property, it is preferable that the second member m2 (screw sc1) is naturally disengaged from the tool 102. When the gravity acting on the second member m2 is defined as M2 (kgf), a ratio (F2/M2) is preferably less than 1, more preferably equal to or less than 0.8, still more preferably equal to or less than 0.6, and yet still more preferably equal to or less than 0.4. The force F2 may be zero.

EXAMPLES

Hereinafter, the effects of the present invention will be clarified by examples. However, the present invention should not be interpreted in a limited way based on the description of the examples.

Example 1

The same golf club as the golf club 2 described above was produced. First, a face member obtained by pressing a rolling material and a back member obtained by casting were produced. An opening existed in a face part of the back member. Next, a screw part (female screw) was formed in a hosel hole of the back member. Furthermore, a socket housing part was formed in the back member. The socket housing part was a recess opened toward the outside of a sole surface.

Separately, a shaft (carbon shaft), a sleeve, an intermediate member, a washer, a screw (second member), and an engaging member were produced. The sleeve was made of an aluminum alloy. The engaging member was made of 6-4 titanium (Ti-6Al-4V). The avoiding part was formed in the screw. The screw was made of 6-4 titanium (Ti-6Al-4V), and the weight of the screw was 1.3 g.

The intermediate member was inserted into the hosel hole of the back member. Then, the engaging member was inserted into the hosel hole of the back member, and a male screw of the engaging member was screw-connected to a female screw of the hosel hole. Next, the engaging member and the hosel hole were welded to each other by laser irradiation from a hosel outer surface. The laser irradiation was performed by utilizing the opening. Next, the face member was welded to the opening of the back member, to obtain a head. The face member and the back member were made of 6-4 titanium (Ti-6Al-4V).

The shaft and the sleeve were bonded to each other with an adhesive, to obtain a shaft-sleeve assembly. The shaft-sleeve assembly was inserted into the hosel hole of the head body. The screw passing through the washer was inserted into a through hole of a sole. The screw was tightened by using the tool 102, to achieve a shaft connection state.

Separately, a socket and a weight body were produced. The socket was formed by injection molding. A thermoplastic polyurethane elastomer was used as the material of the socket. Specifically, a product material obtained by mixing "Elastollan 1164D" with "Elastollan 1198A" at a weight ratio of 1:1 was used.

SUS304 was used as the material of the weight body. The weight body was obtained by molding SUS304. The mass of the weight body was 7 g.

The molded socket was fixed to the socket housing part. An adhesive was used for the fixation. "DP460" (trade name) manufactured by Sumitomo 3M Limited. was used as the adhesive.

The weight body was attached to the socket by using the tool 102 described above, to obtain a golf club of example 1. The angle θ was 40 degrees. The weight of the golf club was 310 g.

Example 2

A golf club according to example 2 was obtained in the same manner as in example 1 except that the engaging part 100*a* (see FIG. 22) was not provided in a weight body.

Example 3

A golf club according to example 3 was obtained in the same manner as in example 1 except that the avoiding part 66*a* (see FIG. 23) was not provided in a screw.

Comparative Example

A golf club according to comparative example was obtained in the same manner as in example 1 except that the engaging part 100*a* was not provided in a weight body, and the avoiding part 66*a* was not provided in a screw.

In example 1, the weight body was not disengaged from the tool in a first connection state. During the attachment/detachment test of the weight body performed 10 times in example 1, the weight body did not fall. In example 1, the screw was disengaged from the tool in a second connection state. During the attachment/detachment test of the shaft performed 10 times, the screw was not taken out by the holding of the screw by the tip part of the tool.

Also in example 2, the weight body was not disengaged from the tool in a first connection state. During the attachment/detachment test of the weight body performed 10 times in example 2, the weight body fell several times. In example 2, the screw was disengaged from the tool in a second connection state. During the attachment/detachment test of the shaft performed 10 times, the screw was not taken out by the holding of the screw by the tip part of the tool.

Also in example 3, the weight body was not disengaged from the tool in a first connection state. During the attachment/detachment test of the weight body performed 10 times in example 3, the weight body did not fall. In example 3, the screw was not disengaged from the tool in a second connection state. During the attachment/detachment test of the shaft performed 10 times, the screw was taken out several times by the holding of the screw by the tip part of the tool.

In comparative example, the weight body was not disengaged from the tool in a first connection state. During the attachment/detachment test of the weight body performed 10 times in comparative example, the weight body was disengaged several times from the tool 102. In comparative example, the screw was not disengaged from the tool in a second connection state. During the attachment/detachment test of the shaft performed 10 times, the screw was taken out several times by the holding of the screw by the tip part of the tool.

Thus, the handling properties of the first member and the second member in each of examples were more excellent than the handling properties of the first member and the second member in comparative example. Advantages of the present invention are apparent.

The invention described above can be applied to all golf club heads.

The above description is merely illustrative example and various modifications can be made in the scope not to depart from the principal of the present invention.

What is claimed is:

1. A golf club kit comprising:

a head;

a socket fixed to the head;

a shaft;

a grip;

a sleeve fixed to a tip part of the shaft;

a first member detachably attached to the socket, the first member being a weight body;

a second member detachably attached to the sleeve and the head to fix the sleeve to the head, the second member being a screw; and a tool capable of being used to detach the first member and the second member, wherein the first member is configured to not disengage under the first member's own weight from the tool in a connection state of the tool and the first member, and wherein the second member is configured to disengage under the second member's own weight from the tool in a connection state of the tool and the second member.

2. The golf club kit according to claim 1, wherein the tool further includes a holding mechanism; and the first member includes an engaging part capable of being engaged with the holding mechanism.

3. The golf club kit according to claim 1, wherein the tool further includes a holding mechanism; and the second member includes a recess capable of avoiding engagement with the holding mechanism.

4. The golf club kit according to claim 1, wherein the tool further includes a holding mechanism;

the holding mechanism includes a projection part biased in a projection direction; and if the projection part is pressed against the biasing, the projection part retracts.

5. The golf club kit according to claim 1, wherein the tool further includes a holding mechanism.

6. The golf club kit according to claim 5, wherein the holding mechanism includes a projection part biased in a projection direction, and if the projection part is pressed against the biasing, the projection part retracts.

7. The golf club kit according to claim 1, wherein the first member includes a first hole to receive the tool, and wherein the second member includes a second hole to receive the tool, the second hole being larger than the first hole.

8. The golf club kit according to claim 1, wherein the first member includes a holding mechanism.

9. The golf club kit according to claim 1, wherein the first member is not configured disengage from the tool under its own weight because of a magnetic force between the tool and the first member, and the second member is configured to disengage from the tool under its own weight because there is no magnetic force between the tool and the second member.

10. The golf club kit according to claim 1, wherein the shaft including the sleeve is configured to be separated from the head in a state where the screw is not separated from the head.

* * * * *